US006117521A

United States Patent [19]

Yoshida et al.

[11] Patent Number: 6,117,521

[45] Date of Patent: Sep. 12, 2000

[54] CONCRETE FORMWORK

[75] Inventors: Hidetsugu Yoshida; Takeyoshi Yamada; Tadao Komoriya; Zenichiro Endo; Yuzo Aito, all of Iwakuni; Nobuo Yoshikiyo; Norio Inokuchi, both of Tokyo, all of Japan

[73] Assignee: Teijin-Metton Kabushiki Kaisha, Chiyoda-ku, Japan

[21] Appl. No.: 08/590,420

[22] Filed: Jan. 24, 1996

[30] Foreign Application Priority Data

| | | | |
|---|---|---|---|
| Jan. 25, 1995 | [JP] | Japan | 7-009484 |
| Nov. 8, 1995 | [JP] | Japan | 7-313766 |
| Nov. 9, 1995 | [JP] | Japan | 7-314922 |

[51] Int. Cl.[7] ..... E04G 11/08

[52] U.S. Cl. ..... 428/119; 428/131; 249/33; 249/47

[58] Field of Search ..... 428/119, 131; 249/33, 47

[56] References Cited

U.S. PATENT DOCUMENTS

| | | | |
|---|---|---|---|
| 2,511,584 | 6/1950 | Hill | 249/47 |
| 3,357,673 | 12/1967 | Williams | 249/47 |
| 4,372,522 | 2/1983 | Simeonoff | 249/18 |
| 4,400,340 | 8/1983 | Klosiewicz | 264/328.6 |
| 4,469,809 | 9/1984 | Klosiewicz | 502/117 |
| 4,957,272 | 9/1990 | Lee | 249/196 |
| 5,020,769 | 6/1991 | Botes | 249/44 |
| 5,632,923 | 5/1997 | Hayakawa | 249/47 |

FOREIGN PATENT DOCUMENTS

| | | |
|---|---|---|
| 6-114816 | 4/1994 | Japan . |
| 6-297434 | 10/1994 | Japan . |
| 7-108520 | 4/1995 | Japan . |
| 7-132533 | 5/1995 | Japan . |
| 7-164451 | 6/1995 | Japan . |

*Primary Examiner*—William P. Watkins, III
*Attorney, Agent, or Firm*—Sherman & Shalloway

[57] ABSTRACT

A plastic, lightweight formwork for concrete, which is an integrally molded article of a crosslinked polymer obtained by mixing a monomer solution A of a metathesis polymerizable cycloolefin containing a catalyst component of a metathesis polymerization catalyst system and a monomer solution B of a metathesis polymerizable cycloolefin containing an activator component of a metathesis polymerization catalyst system, injecting the mixture into a mold and subjecting the mixture to polymerization and a crosslinking reaction in the mold. (1) The formwork has a rectangular plate having a front surface and having a longitudinal length of 1,000–4,000 mm, a lateral length which is ½–1/10 of the longitudinal length and a thickness of 3–10 mm, and a reverse surface of the plate has a frame surrounding the plate and 3 to 6 crosspiece ribs are longitudinally formed on the reverse surface, the frame surrounding the plate having a thickness of 5 to 20 mm and a height of 40 to 100 mm. (2) The crosspiece ribs integrally and longitudinally formed on the reverse surface of the plate have the total thickness of 1/10–1/30 of the lateral length of the plate and the height equivalent to the height of the surrounding frame and are joined to the surrounding frame at both ends thereof. (3) The formwork has a plurality of small reinforcing ribs on at least part of the reverse surface thereof, and the small ribs satisfies the characteristics (i)–(v).

17 Claims, 11 Drawing Sheets

FIG. 1A
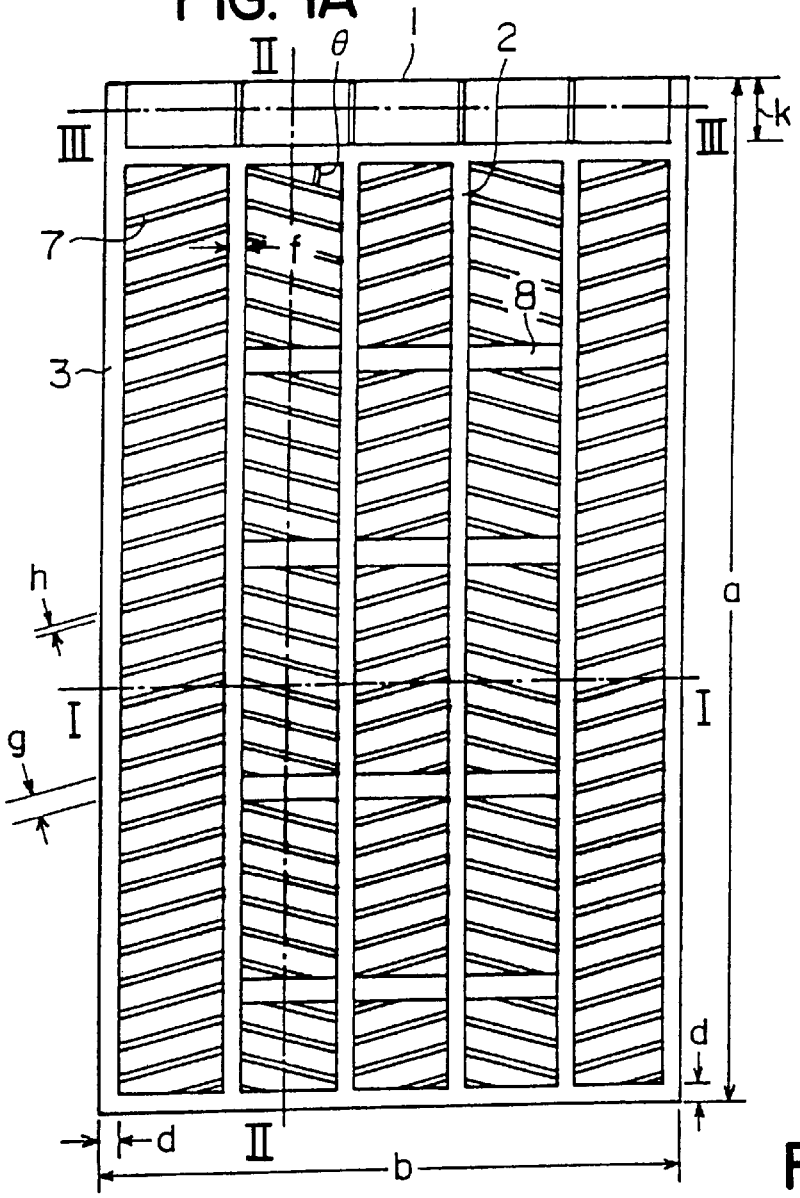
FIG. 1E
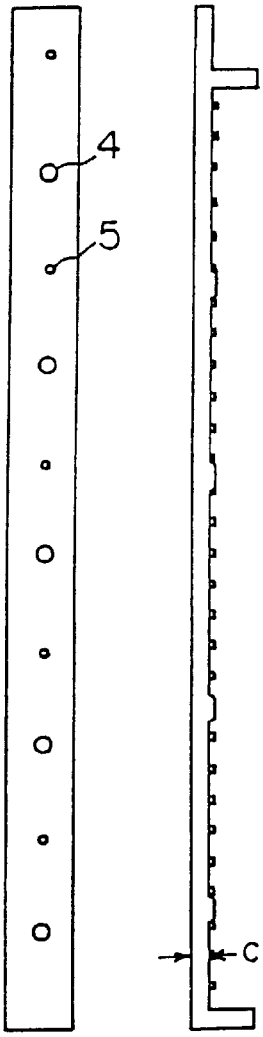
FIG. 1B
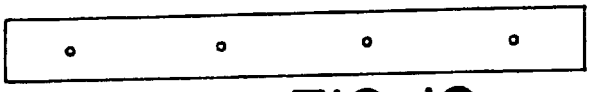
FIG. 1C
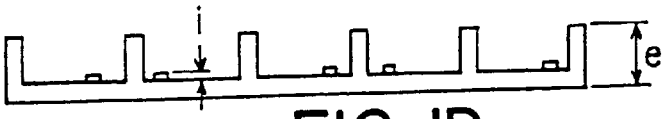
FIG. 1D
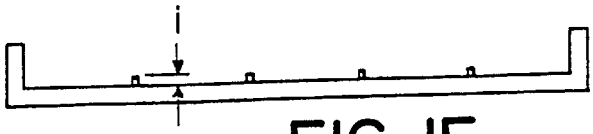
FIG. 1F

CONCRETE FORMWORK

The present invention relates to formworks for concrete (to be sometimes simply referred to as "formwork" hereinafter) formed of a crosslinked polymer of a cycloolefin. More specifically, it relates to integrally molded formworks which have performances equivalent to, or higher than, those of conventional wooden formworks and which are lightweight, easy to assemble and capable of forming a flat concrete surface. Further, specifically, it relates to formworks which can be produced in relatively simple facilities as large-sized ones meeting with demands in a market as compared with plastic formworks which the market is beginning to use, and formworks which can accomplish excellent performances and a decrease in weight.

Prior Art

There is already known a method of producing a molded article of a crosslinked polymer, in which a monomer solution of a metathesis polymerizable cycloolefin containing a catalyst component of a metathesis polymerization catalyst system (to be also called "double decomposition catalyst system") and a monomer solution of a metathesis polymerizable cycloolefin containing an activator component are mixed, the mixture is injected into a mold and the monomers are polymerized and crosslinked in the mold (e.g., U.S. Pat. Nos. 4,400,340 and 4,469,809).

The above injection molding method has excellent advantages in that easily available monomers can be used as a raw material, that the monomers have a low viscosity so that the injection pressure is low, that the polymerization/crosslinking reaction rapidly proceed so that the molding cycle is short, that a large-sized molded article can be relatively easily produced and that a molded article has a good balance between rigidity and impact resistance.

On the other hand, most generally, a wooden formwork has been used as a formwork for concrete. A raw material for wooden formwork is recently becoming difficult to acquire due to the movement toward the protection of a tropical rain forest. Further, some local governments are beginning to impose a restriction on the use thereof. Moreover, actually, a wooden formwork is used only a few times before discarded. Not only a wooden formwork involves the above resource issues, but also the use of wood as a formwork requires a skilled worker for constructions thereof.

Though the use of plastic formworks is gradually starting in recent years, FRP produced by a hand lay up method has a problem in the uniformity of product quality. Further, when a large-sized formwork is produced from a thermoplastic resin by an injection molding method, it is required to use an expensive large-sized injection molding machine, and further, a number of expensive molds are required for producing formworks having various forms.

As explained above, some measures should be taken concerning wood which is conventionally widely used as a raw material for formwork due to a change in market environments, and plastics which are gradually appearing in this field have their own problems. Under the circumstances, there is no formwork commercially available at present which solves all these problems.

For overcoming the above problems, the present inventors have found that a molded article of a crosslinked polymer obtained by mixing a monomer solution A (solution A) of a metathesis polymerizable cycloolefin containing a catalyst component of a metathesis polymerization catalyst system and a monomer solution B (solution B) of a metathesis polymerizable cycloolefin containing an activator component of a metathesis polymerization catalyst system, injecting the mixture into a mold and allowing the mixture to undergo polymerization and a crosslinking reaction is useful as a concrete formwork.

The above formwork for concrete brings excellent results as compared with any other wooden or plastic formwork, while it has been found that a decrease in weight, an improvement in the releasability from concrete, an improvement in the flatness of a concrete surface and simplification of assembly are further desired.

SUMMARY OF THE INVENTION

It is a first object of the present invention to provide a formwork which is repeatedly usable, easy to handle and light in weight and which does not require any operation to attach a frame, crosspiece ribs, etc. or is an integrally molded article of a plate, a frame and crosspiece ribs, by utilizing a method in which a molded article of a crosslinked polymer is produced by concurrently carrying out the polymerization and molding of a metathesis polymerizable cycloolefin in a mold in the presence of a metathesis polymerization catalyst system.

It is a second object of the present invention to provide a formwork which is excellent in releasability from concrete and provides the concrete with a flat surface.

It is a third object of the present invention to provide formworks which are easy to assemble and disassemble and are free of having pieces of concrete formed thereon when used as a formwork.

The present inventors have found that a molded article of a crosslinked polymer obtained by mixing a monomer solution A (solution A) of a metathesis polymerizable cycloolefin containing a catalyst component of a metathesis polymerization catalyst and a monomer solution B (solution B) of a metathesis polymerizable cycloolefin containing an activator component of a metathesis polymerization catalyst system, injecting the mixture into a mold and subjecting the mixture to polymerization and a crosslinking reaction in the mold has performances required of a formwork for concrete. That is, the so-produced molded article has rigidity sufficient for withstanding the weight of concrete charged, releasability sufficient for easily releasing it from the solidified concrete, a specific gravity low enough for worker(s) to carry it, easiness for nailing and sawing required for assembling in a site, durability for repeated use and pollution-free properties such as the generation of no harmful gases when incinerated as waste.

It has been further found that the weight of the above formwork can be decreased by decreasing the thickness of the plate and providing a plurality of small ribs for preventing a decrease in the rigidity of the plate between crosspiece ribs including the side walls, the small ribs having a specific form and being present in parallel or nearly parallel to, a lateral direction (I—I direction in FIG. 1) between crosspiece ribs including the side walls. The present invention has been arrived at on the basis of the above findings.

That is, according to the studies of the present inventors, the above objects of the present invention are achieved by a plastic, lightweight formwork for concrete, which is an integrally molded article of a crosslinked polymer obtained by mixing a monomer solution A (solution A) of a metathesis polymerizable cycloolefin containing a catalyst component of a metathesis polymerization catalyst system and a monomer solution B (solution B) of a metathesis polymerizable cycloolefin containing an activator component of a metathesis polymerization catalyst system, injecting the mixture into a mold and subjecting the mixture to polymerization and a crosslinking the mixture to polymerization and a crosslinking reaction in the mold, the formwork having a plurality of small reinforcing ribs on at least part of a reverse surface thereof, and the small ribs satisfying the following form characteristics (i)–(iv), (i) $2.5 \leqq h \leqq 5$ (ii) $a/100 \leqq H \leqq a/5$ (iii) $5 \leqq i \leqq 20$, and (iv) $0 \leqq \theta \leqq 45$ wherein h is an average thickness of each small rib in the unit of mm provided that the average thickness refers to the thickness of each small rib measured at a point as high as ½ of the small-rib height, H is a total thickness of the small ribs located in one column in the longitudinal direction in the unit of mm, a is a length of the formwork in the longitudinal direction of the formwork in the unit of mm, i is a height of each small rib in the unit of mm, and θ is a smaller angle of angles formed between the length direction of each small rib and a direction in parallel with the lateral direction of the formwork.

According to the present invention, there is provided a formwork for concrete, which has one flat surface having an area of approximately 0.6 to 8 $m^2$, and which has a light weight and durability and has excellent releasability from concrete.

DETAILED DESCRIPTION OF THE INVENTION

The present invention will be described in detail hereinafter.

The metathesis polymerizable cycloolefin used for forming the crosslinked polymer in the present invention is selected from those having one or two of metathesis polymerizable cycloalkene group per molecule. Preferred are metathesis polymerizable cycloolefins having at least one norbornene skeleton per molecule. Specific examples of the metathesis polymerizable tricyclopentadiene, cyclopentadiene-methylcyclopentadiene codimer, 5-ethylidene norbornene, norbornene, norbornadiene, 5-cyclohexenyl norbornene, 1,4,5,8-dimethano-1,4,4a,5,6,7,8,8a-octahydronaphthalene, 1,4-methano-1,4,4a,5,6,7,8,8a-octahydronaphthalene, 6-ethylidene-1,4,5,8-dimethano-1,4,4a,5,6,7,8,8a-octahydronaphthalene, 6-ethylidene-1,4-methano-1,4,4a,5,6,7,8,8a-octahydronaphthalene, 1,4,5,8-dimethano-1,4,4a,5,8,8a-hexahydronaphthalene, ethylene-bis(5-norbornene) and the like. The above cycloolefins may be used alone or in combination. Particularly preferred is dicyclopentadiene or a mixture containing at least 50 mol %, preferably at least 70 mol %, of dicyclopentadiene. A metathesis polymerizable cyclic olefin having a polar group containing a different element such as oxygen or nitrogen may be used as a copolymerizable monomer as required. The copolymerizable monomer preferably contains a norbornene structural unit and preferable examples of the polar group include ester, ether, cyano, N-substituted imide, halogen and the like. Illustrative examples of the copolymerizable monomer include 5-methoxycarbonyl norbornene, 5-(2-ethylhexyloxy)carbonyl-5-methyl norbornene, 5-phenyloxymethyl norbornene, 5-cyanonorbornene, 6-cyano-1,4,5,8-dimethano-1,4,4a,5,6,7,8,8a-octahydronaphthalene, N-butyl Nadic acid imide, 5-chloronorbornene and the like.

In the present invention, the monomer solution A (solution A) contains a catalyst component of metathesis polymerization catalyst system. The catalyst component is selected from salts such as halides or ammonium salts of metals like tungsten, rhenium, tantalum and molybdenum, and a tungsten compound is particularly preferred. The tungsten compound is preferably selected from tungsten hexahalides, tungsten oxyhalides. More specifically, tungsten hexachloride and tungsten oxychloride are preferred. Further, organic ammonium tungstate may be also used. It is not preferred to add the tungsten compound directly to the monomer since a cation polymerization is immediately initiated. Before use, therefore, it is preferred to suspend the tungsten compound in an inert solvent such as benzene, toluene or chlorobenzene and solubilize it by adding a small amount of an alcohol compound and/or a phenolic compound. For preventing the above undesirable polymerization, it is preferred to add a Lewis base or a chelating agent in an amount of approximately 1–5 mol per mole of the tungsten compound. The Lewis base or chelating agent includes acetylacetone, acetoacetic acid alkyl esters, tetrahydrofuran and benzonitrile. Some polar monomers can be Lewis bases showing the above function without adding the above compound. The so-prepared monomer solution A (solution A) containing a catalyst component is substantially sufficiently stable.

On the other hand, the monomer solution B (solution B) contains an activator component of a metathesis polymerization catalyst system. The activator component is selected from organometal compounds, mainly alkylated products of metals of the groups I–III of the periodic table. Particularly preferred are tetraalkyl tin, alkyl aluminum compounds and alkyl aluminum halide compounds such as diethyl chloride aluminum, ethyl dichloride aluminum, trioctyl aluminum, dioctyl aluminum iodide, tetrabutyl tin and the like. The monomer solution B (solution B) is prepared by dissolving the organometal compound as an activator component to the monomer.

A molded article of a crosslinked polymer is obtained by mixing the solution A and the solution B and injecting the mixture into a mold. However, the problem in many cases is that the above mixture (composition) can undergo polymerization so quickly that the curing of the mixture may take place before the mold is fully filled. It is therefore preferred to use an activity moderator. The moderator is generally selected from Lewis bases, particularly from ethers, esters and nitrites. Specific examples of the moderator include ethyl benzoate, butyl ether and diglyme. When the moderator is used, generally, it is included to the solution B containing the activator of an organometal compound. When a monomer having a Lewis base group is used as described above, the base also works as a moderator.

The metathesis polymerization catalyst is used in the following amount. For example, when a tungsten compound is used, the raw material/tungsten compound molar ratio is approximately in the range of 1,000/1–15,000/1, preferably around 2,000/1. When an alkylaluminum compound is used, the raw material/aluminum compound molar ratio is approximately in the range of 100/1–10,000/1, preferably around 200/1–1,000/1. The amounts of the above Lewis base agent and the above moderator can be properly experimentally determined depending upon the amounts of the above catalyst systems.

Basically, the molded article of the present invention can be obtained by mixing the above solution A and the above solution B and injecting the mixture into a mold. The catalytic activity of the metathesis catalyst system formed by mixing the solution A and the solution B can be expressed as a length of time from the formation of the mixture of the two solutions to a time when the mixture loses its flowability. When the above length of time up to a time when the mixture loses its flowability is defined to be a length of time from the placing of the two solutions in a glass container having a stirrer to a time when the mixture gels and starts to be caught on a stirring blade, desirably, the length of time for which the solution A and the solution B lose their flowability when mixed at an initial temperature of 30° C. in the reaction is 1 to 120 seconds, preferably 2 to 100 seconds.

The molded article of a crosslinked polymer obtained by the present invention may contain an additive for improving or retaining its properties as required for practical use. The additive includes an elastomer, a filler, a reinforcement, an antioxidant, a heat stabilizer, a pigment, a light stabilizer, an ultraviolet absorbent, a lubricant, an antistatic agent, a flame retardant, a foaming agent, a softening agent, a tackifier, a plasticizer, a mold releasing agent, a deodorant, a perfume and an extender. These additives may be used alone or in combination.

The above additive, which is contained in a crosslinked polymer phase of the molded article of the present invention, is selected from those which are non-reactive with the metathesis polymerizable cycloolefins as monomers and which may be soluble, or insoluble, in the monomers. The additive can be any one of those which can improve some function of the molded article or impart the molded article with some function when incorporated. The additive is selected from those which are generally used as additives for resins. It is not possible to incorporate the additive after the crosslinked polymer is formed, and it is therefore necessary to add the additive to the monomer solution(s) in advance when the additive is incorporated.

The additive can be the most easily added by a method in which it is added to one or both of the solutions A and B. In this case, the additive is required not to substantially react with any one of the highly reactive catalyst component and the activator component in the solutions A and B and is required not to hinder the polymerization to a substantial extent. When the additive is reactive but does not hinder the polymerization, the additive may be mixed with a monomer to prepare a third solution, and the third solution may be added immediately before the polymerization. Further, when the additive is a solid filler having a form which allows, when left in the mold, full filling of a space in the mold with the mixture of the solutions A and B immediately before or during the polymerization, the additive may be placed in the mold in advance.

Although differing depending upon its kind, the amount of the additive based on the crosslinked polymer phase is 0.01 to 50% by weight, preferably 0.1 to 30% by weight.

Specific examples of the above additive are as follows.

(a) Elastomer

A broad range of elastomers such as styrene-butadiene-styrene triblock rubber, styrene-isoprene-styrene triblock rubber, polybutadiene, polyisoprene, butyl rubber, ethylene-propylene-diene terpolymer and nitrile rubber.

(b) filler and reinforcement

Calcium carbonate, clay, aluminum oxide, glass fiber, polyethylene powder, synthetic fiber powder (fibrous, particulate), wollastonite, talc, barium sulfate, carbon fiber, metal fiber, carbon black, graphite and whisker.

(c) Antioxidant and heat stabilizer

Hindered phenol-containing antioxidants such as 2,6-di-tert-butyl-4-methylphenol, sulfur-containing antioxidants such as dilaurylthiopropionic acid ester, and phosphorus-containing antioxidants such as trisnonylphenylphosphite.

(d) Pigment

Titanium oxide, carbon black, red iron oxide, phthalocyanine blue and cadmium yellow.

(e) Light stabilizer and Ultraviolet absorbent

Benzophenones, benzotriazoles, benzoates, salicylic acid derivatives, acrylonitrile derivatives and a light stabilizer having a hindered piperidine skeleton (HALS).

(f) Hydrocarbons such as liquid paraffin, esters such as butyl stearate, fatty acid amides such as stearic acid amide, and higher fatty acid metal salts such as barium stearate.

(g) Antistatic agents

Anionic surfactants such as alkylsulfonic acid salt, cationic surfactants such as alkyltrimethylammonium, nonionic surfactants such as glyceric acid ester, esters of polyhydric alcohols such as pentaerythritol, phosphoric acid oxides such as phosphoric acid triester, quaternary ammonium salt, and polyethylene glycol.

(h) Flame retardant p Antimony oxide, various organic boron compounds, various organic chlorine compounds, various phosphate esters and various nitrogen compounds.

(i) Foaming agent $C_4$-$C_7$ aliphatic hydrocarbons, chlorinated aliphatic hydrocarbons, fluorinated hydrocarbons, particulate powder obtained by encapsulating a low-boiling-point component in an organic substance, and nitrogen or argon gas dissolved in a liquid for injection.

(j) Softening agent

Paraffin oil, naphthene oil and aromatic oil (k) Tackifier

Chroman resin, phenolic resin, rosin derivative, terpene resin and petroleum-based hydrocarbon resin.

(l) Plasticizer

Polyester-containing plasticizers such as phthalic acid ester, epoxy-containing plasticizers such as epoxidized triglyceride, and phosphate esters such as tricresyl phosphate.

(m) Mold releasing agent (Improver for releasing a product from a mold)

Silicone oil, metallic soap, stearic acid ester and wax.

(n) Deodorant and perfume

Hexahydro-4,7-methanoinden-5(or 6)-yl-acetate, 2-buten-1-one-1-(2,6,6-trimethyl-1,3-cyclohexadien-1-yl), methyl salicylate, citronellyl ether and 1,3,5-undecatriene.

(o) Extender

Recycled polyethylene powder, waste oil and C heavy oil.

The material for a mold for forming the formwork for concrete, provided by the present invention, is selected from steel, cast or forged aluminum, sprayed or cast alloys of zinc, etc., electroformed nickel or copper, and a resin. The mold has a simple structure since the pressure to be generated in the mold is very low, as low as a few kg/cm$^2$, as compared with that in other molding method, and the mold can be therefore produced at a low price as compared with other molding method.

BRIEF DESCRIPTION OF DRAWINGS

FIGS. 1A, 1B, 1C, 1D, 1E and 1F shows one embodiment of the formwork of the present invention. A shows a plan view, B shows a side view in the longitudinal (length) direction, C shows a side view in a lateral (width) direction, D shows a cross section taken along I—I direction, E shows a cross section taken along II—II direction, and F shows a cross section taken along III—III direction.

FIG. 3A and FIG. 3B show a state in which a junction member 6 is put in that structural portion of the formwork in each of FIGS. 1, 4 and 5 where the junction member can be put in.

FIG. 9 shows a perspective view of the formwork, viewed from a position facing the reverse surface (opposite surface to the surface which contact concrete) of the formwork.

Figure 2A:
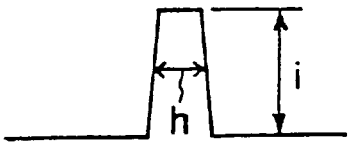
FIGS. 2A and 2B show examples of the cross-sectional form of a small rib of the formwork of the present invention.

In these Figures, numerals or symbols indicate the following.

1. Plate
2. Crosspiece rib
3. Frame
4. Hole
5. Small hole
6. Junction member
7. Small rib
8. Separator attaching portion
9. Boss
10. Rib
11. Gap
12. Deflection point
a. Longitudinal length of plate
a'. Longitudinal length of range of small ribs formed between crosspiece ribs
a". Longitudinal length of range of small ribs formed between side wall and crosspiece rib
b. Lateral length of plate
b'. Lateral length between side wall and crosspiece rib
b". Lateral length between crosspiece ribs
c. Thickness of plate
d. Thickness of frame
e. Height of frame
f. Thickness of crosspiece rib
g. Distance between small ribs
h. Average thickness of small ribs
i. Height of small rib
k. Length of structural portion in which junction member can be put in.
θ. Smaller angle of angles formed between length direction of small rib and a direction in parallel with lateral frame.
D. Diameter of clip
l. Formwork insertion portion
L. L-letter shaped portion
U. U-letter shaped portion
O. Opening of U-letter portion (clamping portion)

The structure of the formwork for concrete, provided by the present invention, will be explained with reference to drawings hereinafter.

FIG. 1 shows one embodiment of the formwork of the present invention. A is a plan view, B is a side view in a longitudinal direction, C is a side view in a lateral direction, D is a cross-sectional view taken along an I—I direction, E is a cross-sectional view taken along a II—II direction, and F is a cross-sectional view taken along a III—III direction.

In FIG. 1A, the formwork has a rectangular plate 1 as shown in the plan view, and the plate 1 has a surface (to be sometimes referred to as "front surface" hereinafter) which contacts concrete when the concrete is charged, and the other surface (to be sometimes referred to as "reverse surface" hereinafter) where a plurality of small ribs 7 are formed. The surface where the small ribs are formed is surrounded by a frame 3 as shown in FIG. 1, and preferably, a plurality of crosspiece ribs 2 (four ribs in FIG. 1) are formed in the longitudinal direction. Further, the surface which contacts concrete is shown as a flat surface in FIG. 1 (the other surface of the formwork shown in FIG. 1A). When a concrete surface has a curve and/or a pattern, the surface which contacts concrete has a corresponding curve and/or a corresponding pattern.

In a preferred structure of the formwork of the present invention, the longitudinal length (shown as a in FIG. 1) is generally in the range of 1,000–4,000 mm, preferably 1,200–2,500 mm. The lateral length (shown as b in FIG. 1) is in the range of ½–1/10 of the longitudinal length, preferably ⅓–⅕ of the longitudinal length. The thickness of the plate 1 is properly in the range of 3–10 mm, particularly preferably 4–8 mm. Further, the thickness of the plate 1 is not necessarily required to be uniform as a whole, and it may vary in the longitudinal direction.

A plurality of the small ribs (a number of small ribs in FIG. 1) are provided on the reverse surface of the plate 1 in a nearly lateral direction. Generally, it is sufficient that the small ribs should be provided in a nearly lateral direction (nearly I—I direction), and the most preferably, the small ribs form an angle θ of about 15° to a lateral frame provided in a horizontal direction and are provided at nearly equal intervals as shown in FIG. 1. Further, each small rib preferably has such a length that they are connected to neighboring longitudinal crosspiece ribs or to a longitudinal crosspiece rib 2 and a longitudinal frame 3. The above angle of each small rib to a horizontal direction is not necessarily required to be 15°, and it is 0–45°, preferably 10–30°. When the above angle is small, air bubbles are liable to remain in a central portion of each small rib due to the solution flow at a molding time. When it is too large, the plate surface between crosspiece ribs warps due to a pressure on the plate generated by charged concrete.

Advantageously, the thickness h of each small rib is as follows. The total thickness H of the small ribs (total of h's) in a column in a longitudinal direction is ⅕–1/100, preferably ⅛–1/50, of the longitudinal length (a in FIG. 1) of the plate.

Further, the height of each small rib is preferably smaller than the height (e in FIG. 1D) of the surrounding frame 3 in view of molding and use of the formwork. When the total thickness H of the small ribs is greater than ⅕ of the longitudinal length (a in FIG. 1) of the plate, the effect on a decrease in the weight of the formwork is low. When it is smaller than 1/100, the rigidity of the formwork is low. The small ribs are preferably distributed such that the number thereof is large as shown in FIG. 1, for effective exhibition of rigidity, while the thickness of each small rib is preferably at least 2 mm in view of physical properties. Each small rib has an average thickness of 2.0–5 mm, preferably 2.5–4.5 mm.

Figure 4A:
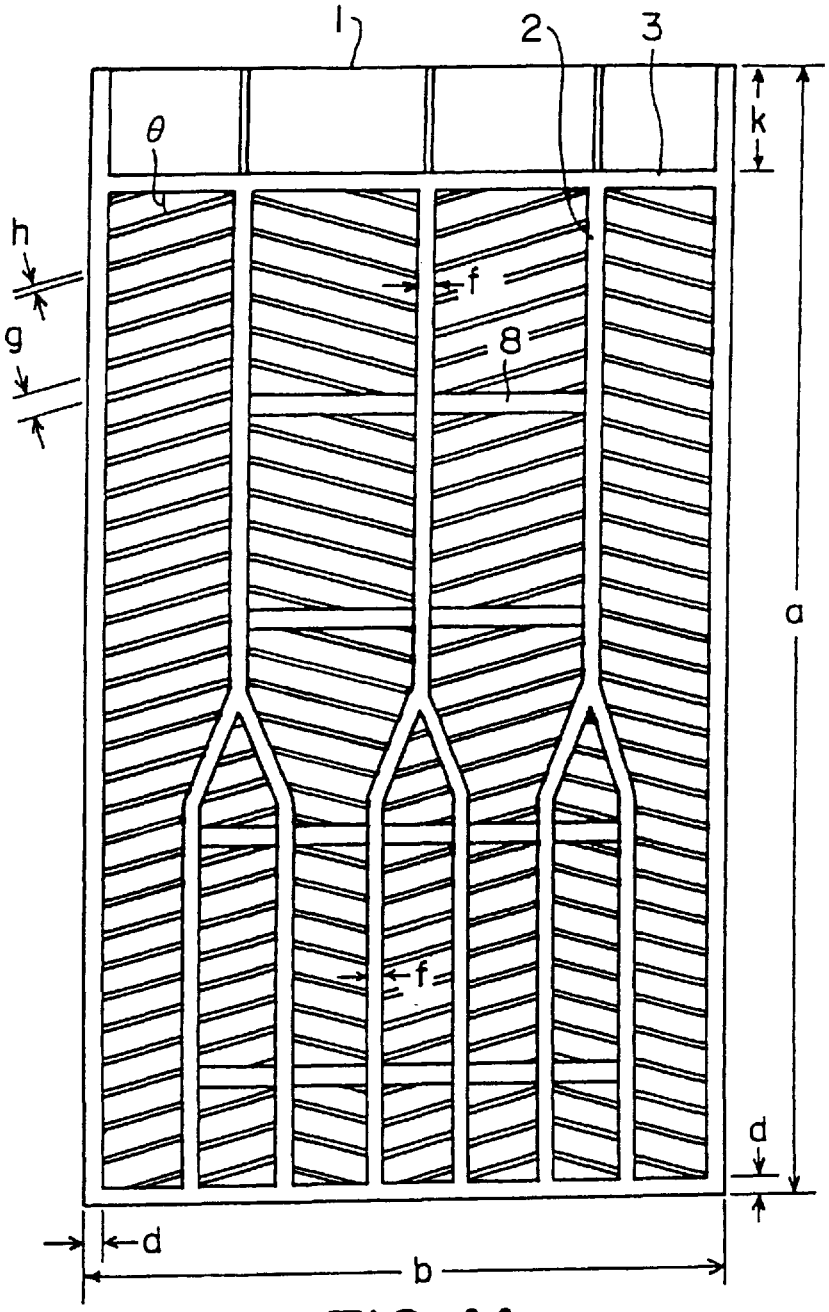
FIGS. 4A, 4B and 4C show a plan view A and side views B and C of another embodiment of the formwork of the present invention.
Figure 4B:
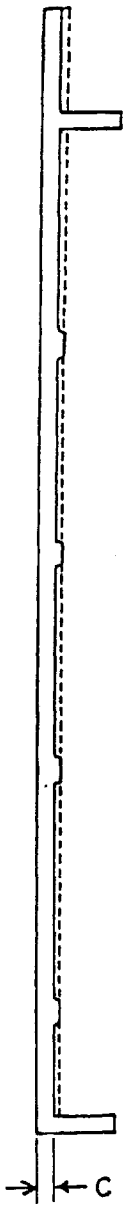
Figure 4C:
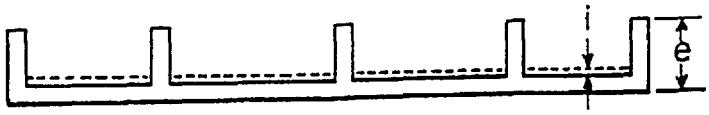
Figure 5A:
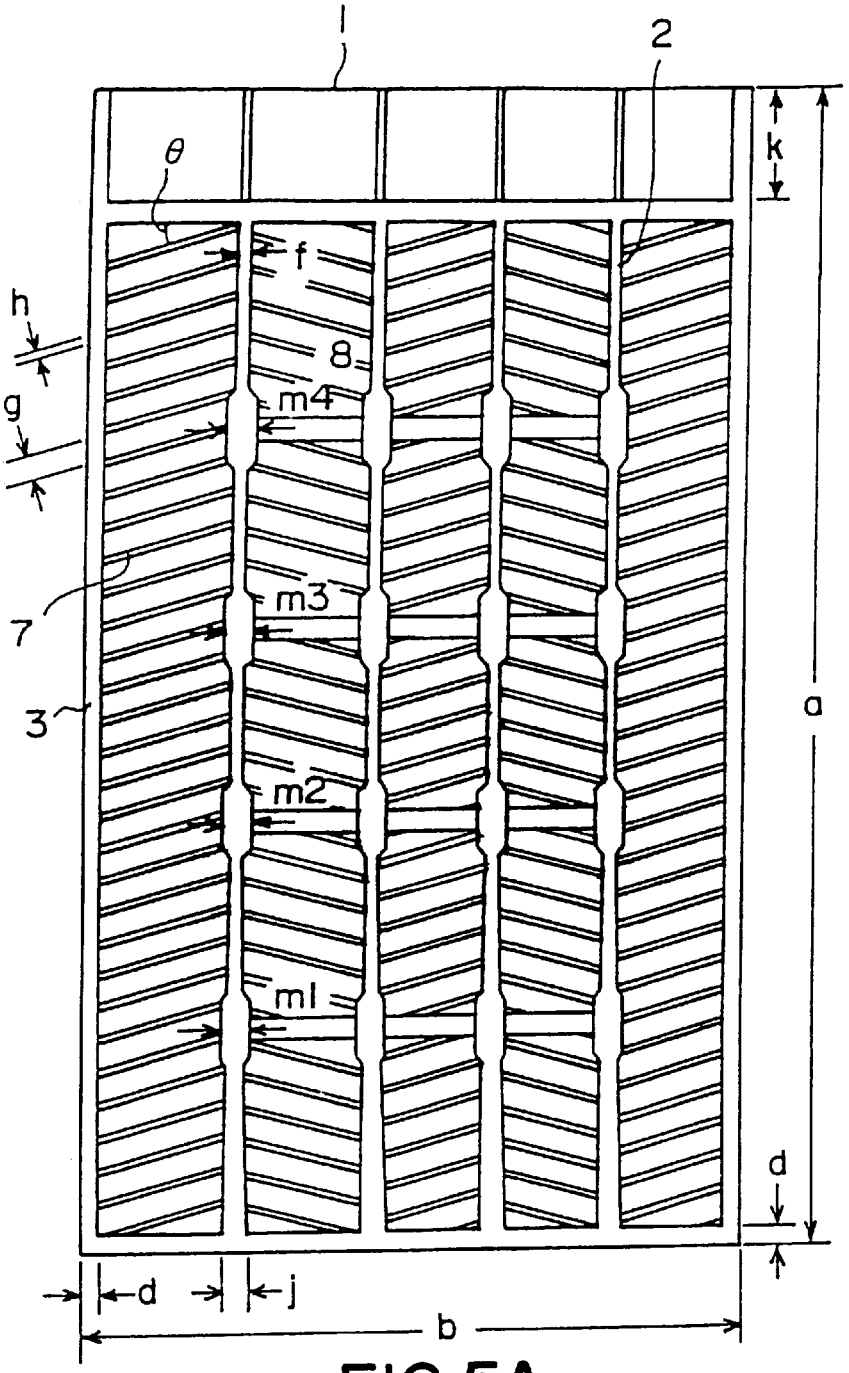
FIGS. 5A, 5B, and 5C show a plan view A and side views B and C of another embodiment of the formwork of the present invention.
Figure 5B:
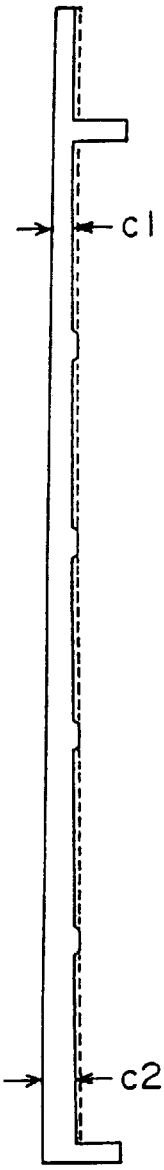
Figure 5C:
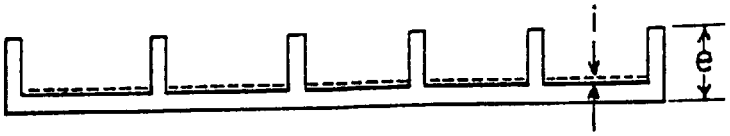
Figure 6:
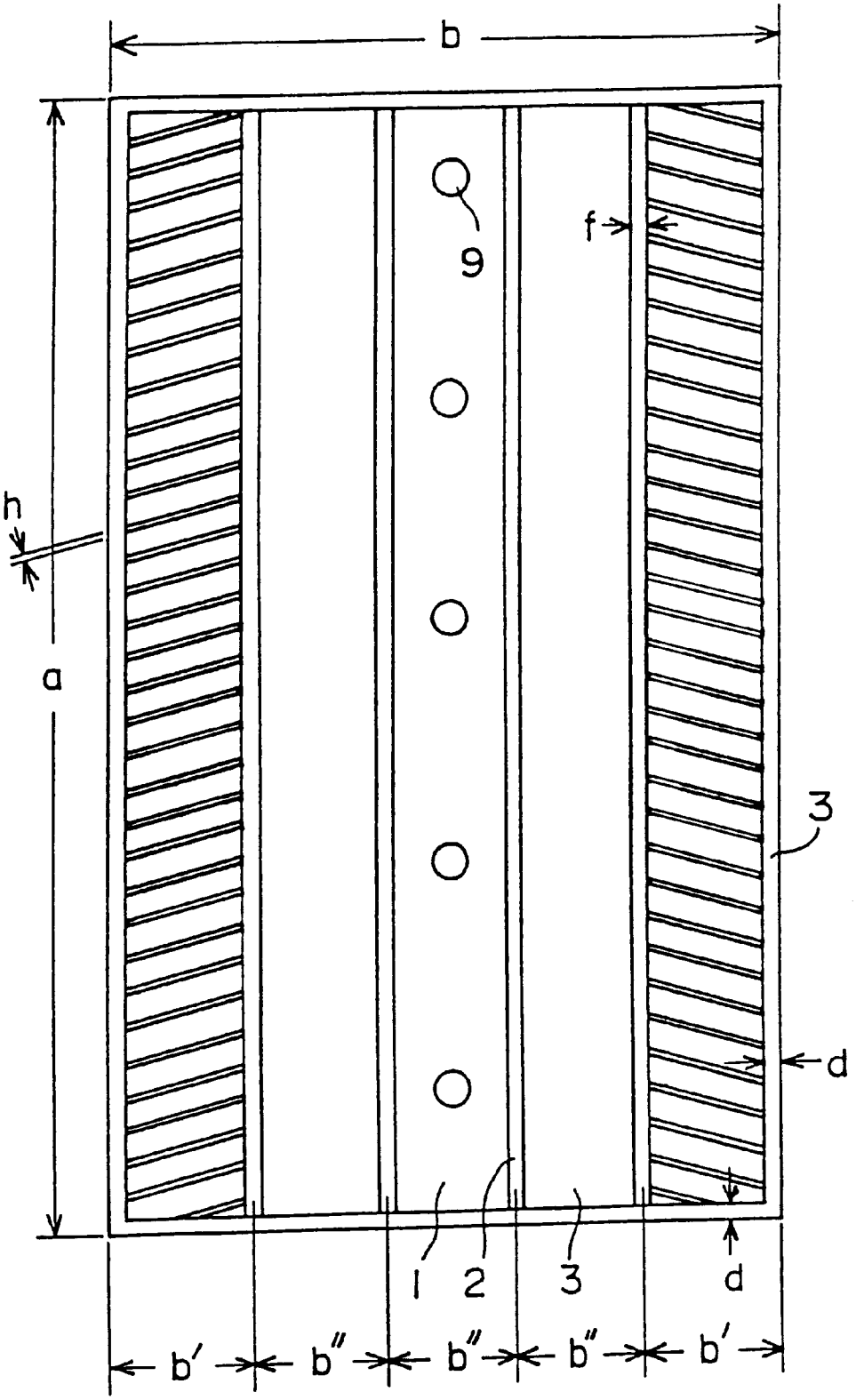
FIG. 6 shows a plan view of another embodiment of the formwork of the present invention, i.e., another embodiment of the portion surrounded by a and b in FIG. 1A.
Figure 7:
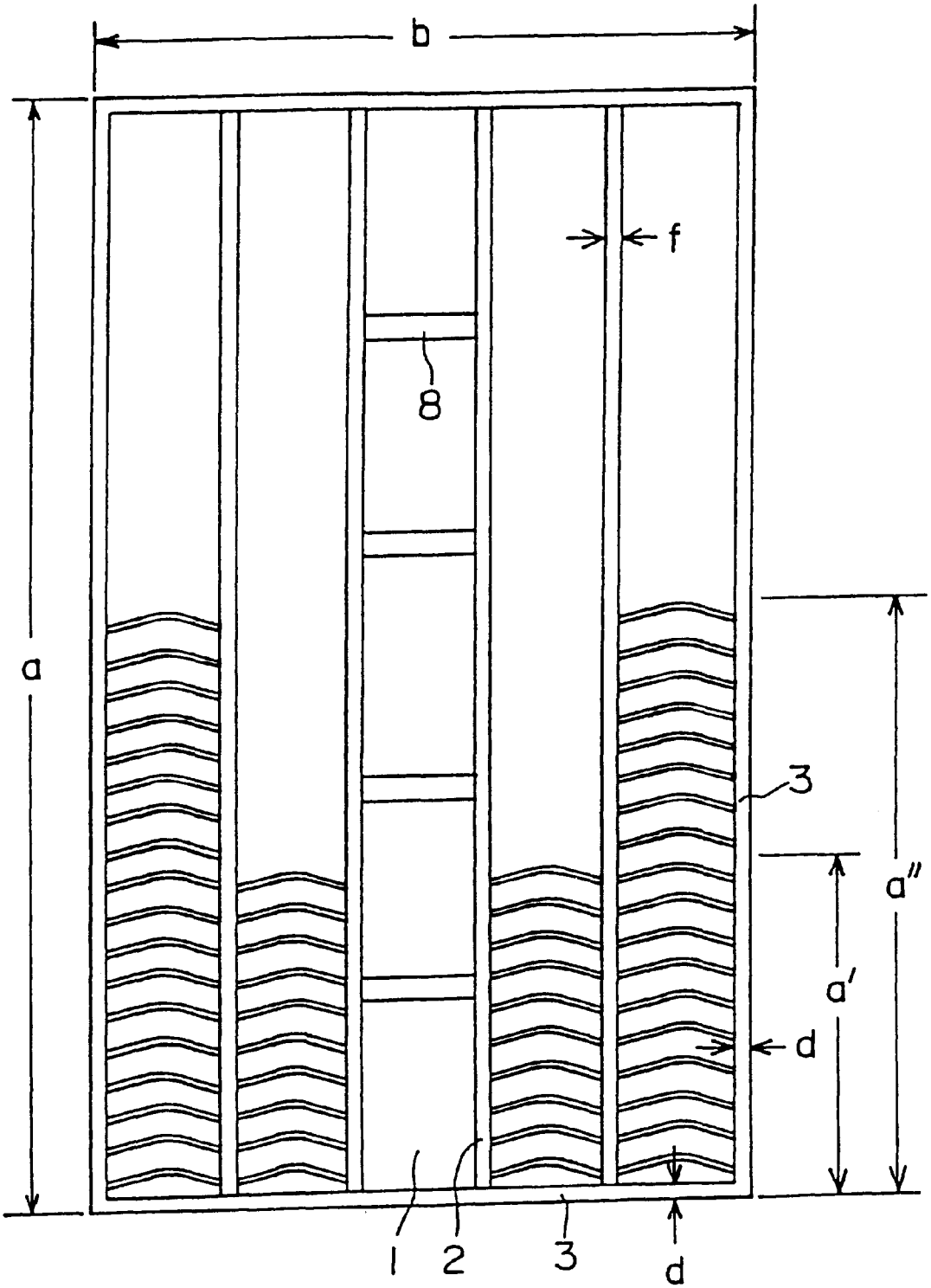
FIG. 7 shows a plan view of another embodiment of the formwork of the present invention, i.e., another embodiment of the portion surrounded by a and b in FIG. 1A.
Figure 8A:
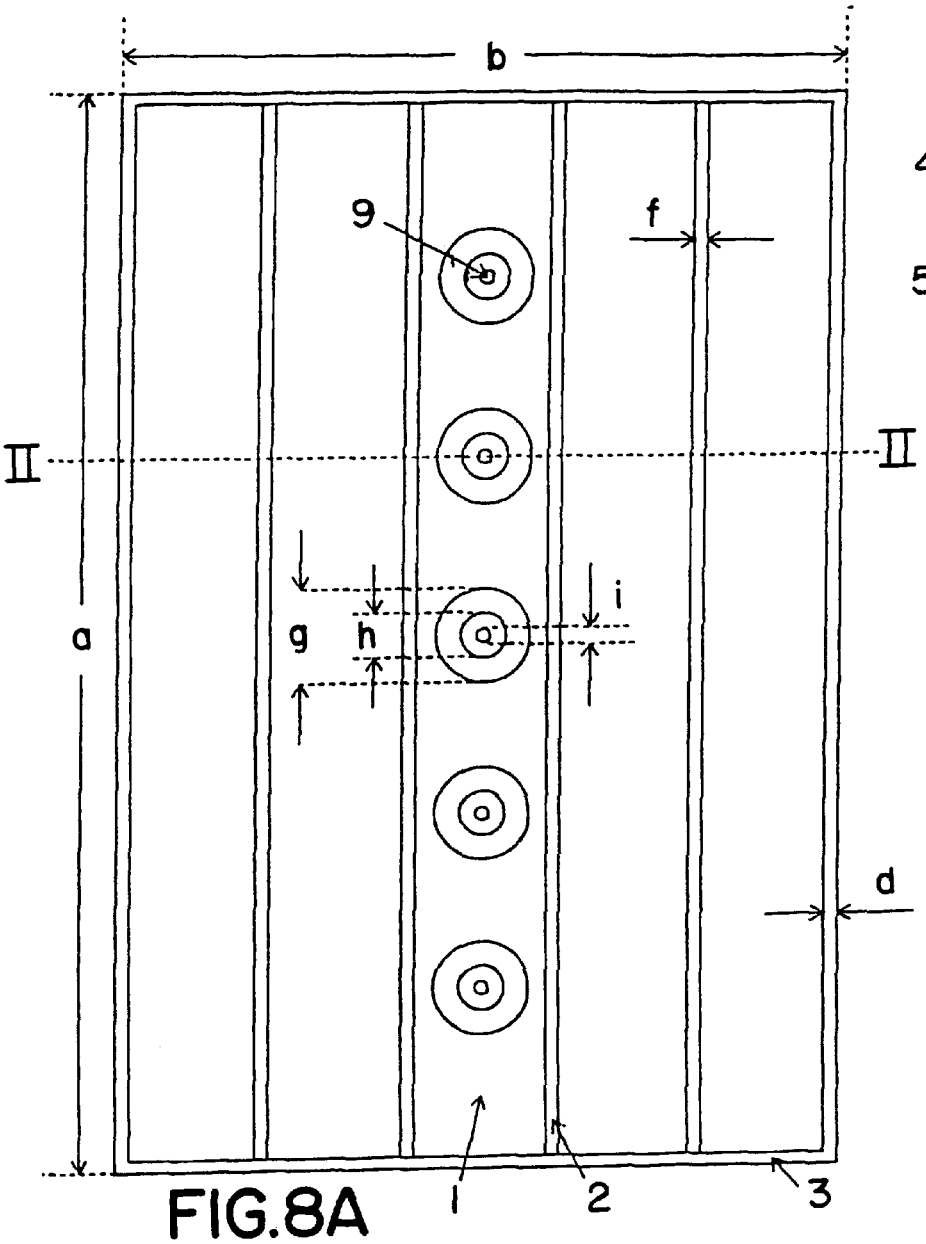
FIGS. 8A, 8B, 8C, and 8D show another embodiment of the formwork of the present invention. A shows a plan view, B shows a side view in the longitudinal (length) direction, C shows a side view in a lateral (width) direction, and D shows a cross section taken along II—II direction.
Figure 8B:
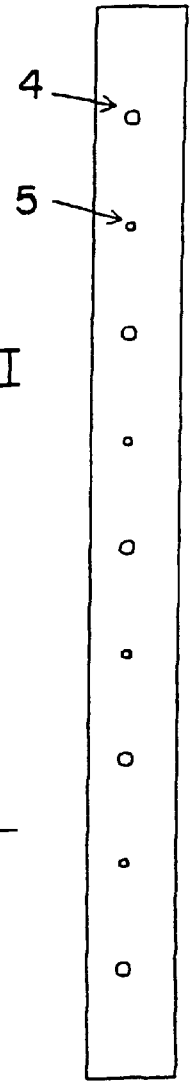
Figure 8C:
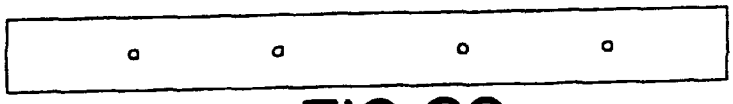
Figure 8D:
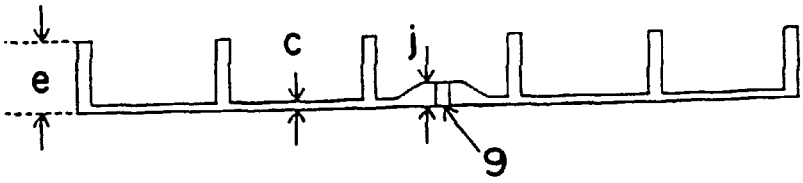

Further, the small ribs may be formed all over on the reverse surface of the plate as shown in FIGS. 1, 4 and 5, or the small ribs may be formed on at least partial region of the reverse surface as shown in FIGS. 6 and 7. When the small ribs are formed on a partial region, the region is preferably at least 20%, particularly preferably at least 30%, of the total area of the reverse surface.

Figure 2B:
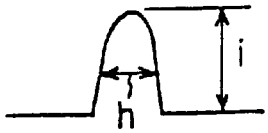
Figure 2C:
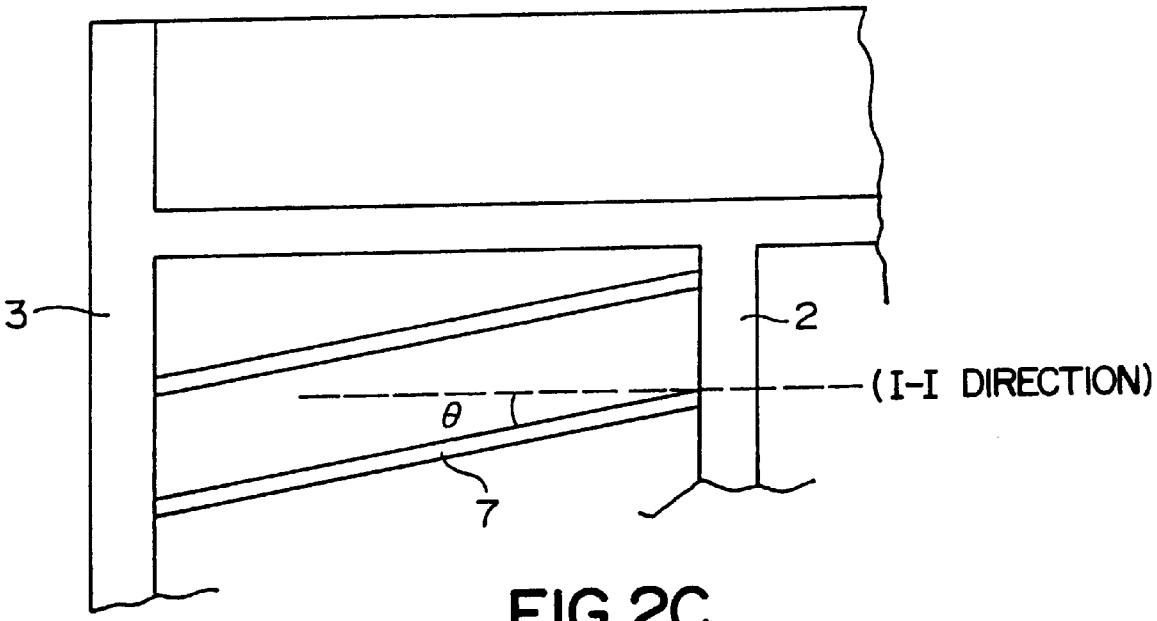
FIG. 2C shows a plan view for the definition of θ.

The small rib/small rib distances g are not necessarily required to be constant, while the small rib/small rib distances are preferably constant for maintaining effective rigidity of the whole formwork. FIG. 2 shows forms of the small rib and arrangement of the small ribs having an angle θ to the horizontal direction. Advantageously, the height of each small rib is 5 to 20 mm, preferably 8 to 15 mm. A small height of the small ribs is not advantageous in view of rigidity, and the small ribs having too large a height are difficult to produce by molding.

The reverse surface of the formwork (surface which is not brought into contact with concrete) has a surrounding frame 3, and a plurality of crosspiece ribs 2 (four crosspiece ribs in FIG. 1) provided in the longitudinal direction. The surrounding frame 3 has a thickness (d in FIG. 1) of 5–20 mm, preferably 5–10 mm, particularly preferably 6–9 mm. The frame 3 has a height (e in FIG. 1D) of 40–100 mm, preferably 40–70 mm, particularly preferably 50–65 mm. The surrounding frame 3 is structurally preferably provided along substantially all the edges of the plate, while it may be partly discontinued.

A plurality of the crosspiece ribs (four crosspiece ribs in FIG. 1) are provided in the longitudinal direction of the plate. These crosspiece ribs may be provided nearly in the longitudinal direction, and the most preferably, the crosspiece ribs 2 are provided at nearly equal intervals in parallel with the longitudinal frame 3 as shown in FIG. 1. The crosspiece ribs preferably have such a longitudinal length that each end thereof joins the surrounding frame 3. However, the crosspiece ribs 2 are not necessarily required to be in parallel with the longitudinal frame 3, and they may be provided so as to have an angle of up to 30°, preferably up to 20°, to the longitudinal frame 3. The structure, number and angle of the crosspiece ribs have a great influence on the strength of the formwork. The number of crosspiece ribs 2 is generally 3–6, preferably 4–5. The total thickness of the crosspiece ribs (total of f's) is 1/10–1/30, preferably 1/12–1/25, of the lateral length (b in FIG. 1A) of the plate. The height of each crosspiece-rib 2 is preferably equivalent to the height (e in FIG. 1D) of the surrounding frame 3 in view of use. The number of the crosspiece ribs 2 is not necessarily required to be constant all over the plate, and the crosspiece ribs 2 may be formed, for example, as shown in FIG. 4.

It is sufficient that the thickness of the crosspiece ribs 2 should satisfy the above conditions. Each crosspiece rib may have a thickness uniform in the longitudinal direction as shown in FIG. 1 (f in FIG. 1A), or each crosspiece rib may have a thickness which changes to some extent in the longitudinal direction as shown in FIG. 5A. In another embodiment, each crosspiece rib may have a thickness which is increased in one direction (FIG. 5A). When the crosspiece ribs have a thickness which is increased in one direction, the formwork having such crosspiece ribs can be provided so that a portion having thickness-increased rib portions stands against that portion of concrete with a higher pressure. Further, the spinal plate portion (provided with the crosspiece ribs 2) may have a thickness which is gradually increased as shown in FIG. 5.

The crosspiece ribs are advantageously provided such that the distance of the neighboring crosspiece ribs at any point is not more than 200 mm, preferably not more than 150 mm.

Side wall of the formwork of the present invention may be provided with holes 4 through which bolts or clips are fit or small holes 5 as shown in FIG. 1B and FIG. 1C.

The reverse surface of the formwork of the present invention may have thickness-increased portions (e.g., 8 in FIG. 1A) for supporting separators (tooling for keeping a concrete thickness at a constant level).

The formwork of the present invention may have a structure in which junction member(s) can be integrated, or may have junction member(s) integrated and fixed, on at least side in the longitudinal direction.

The junction member is generally selected from square timbers. The junction member provided in a side (end) portion of the plate constitutes a junction member for fixing the formwork to a beam-forming formwork or a bottom-forming formwork by nailing, or the like. The junction member is therefore required to withstand fixing means such as nailing or clamping with a bolt, and it preferably has a cross-sectionally square form. When the formwork having a junction member integrated is used as a member for a combination of a plurality of formworks, a beam-forming formwork can be nailed through the junction member, and the formwork can be used repeatedly. The junction member preferably has a thickness equivalent to the height of the crosspiece rib.

Figure 3A:
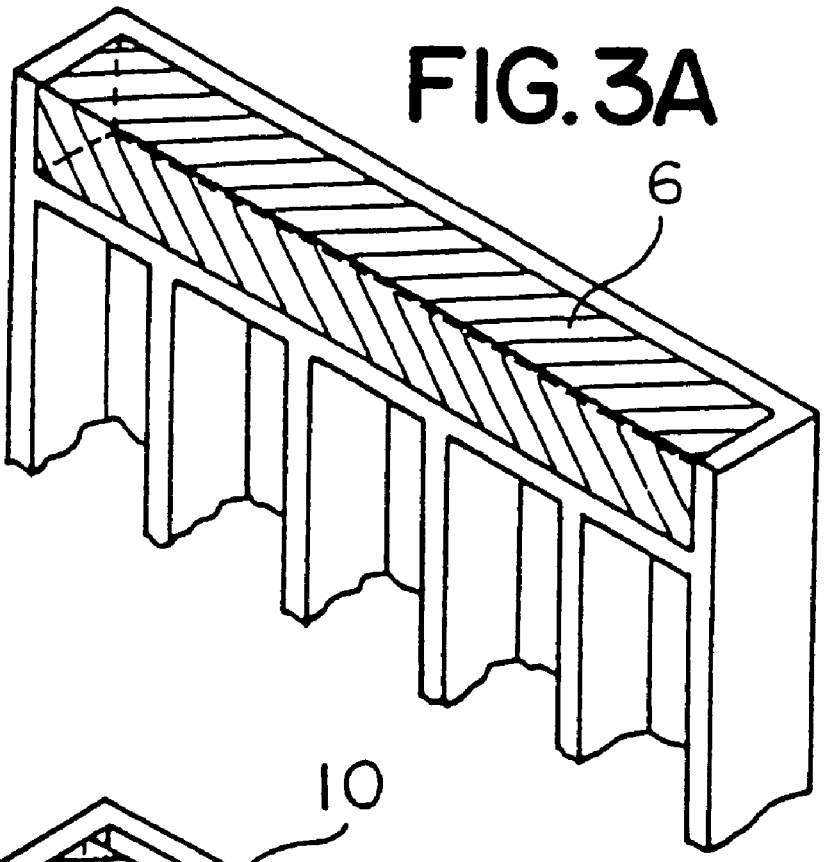
FIGS. 3A and 3B show partial perspective views showing a state in which a junction member is put in the formwork of the present invention.
Figure 3B:
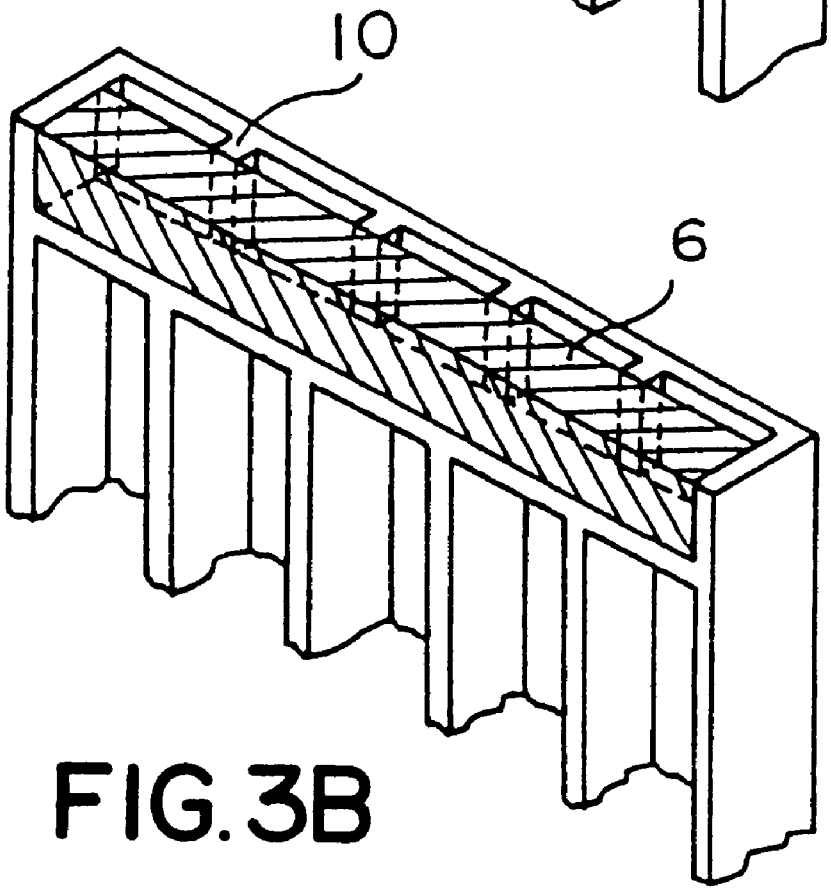

The junction member can be attached by any one of method FIG. 3A and method FIG. 3B (using ribs 10 for adjusting the thickness of the junction member to the height of the crosspiece rib) shown in FIG. 3. The formwork may be provided with one junction member on one side, or with one junction member on one side and the other junction member on the other side.

It has been found that when the formwork of the present invention is integrally produced by a crosslinking polymerization in a mold according to a conventional method, i.e., when the formwork having crosspiece ribs, a boss for attaching a separator, etc., on the reverse surface is integrally produced by molding, a concave portion (sink mark) is liable to occur on those portions of the front surface (concrete contact surface) which correspond to the crosspiece ribs, the boss, etc., due to contraction at a molding time.

In the present specification, the above concave portion caused on the front surface of the formwork due to the above crosspiece ribs, boss, etc., will be referred to as "sink mark" (concave portion). When the depth of the sink mark on the front surface exceeds some value, the flatness of concrete is impaired, and it is required to modify the concrete surface, for example, for attaching a sheet of wall paper.

The present inventors have found that when the depth of the sink mark is within a specific range, the formwork has no substantial influence on the formation of a flat concrete surface.

The above "boss" refers to a thickness-increased portion on part of the plate, including a thickness-increased portion where a hole is made for attaching a separator or a thickness-increased portion for some other purpose. The form of the boss may be circular or rectangular. Generally, the formwork for concrete is provided with 1–5 bosses for attaching separators.

As described above, the present invention can provide a formwork for concrete, which is an integrated molded article of a crosslinked polymer obtained by the polymerization and crosslinking reaction of the above metathesis polymerizable cycloolefin, which has at least one crosspiece rib integrally formed on the reverse surface thereof in the longitudinal direction thereof or has at least one crosspiece rib integrally formed on the reverse surface thereof and at least one both integrally formed, and which has a front surface on which the sink mark caused by the presence of the crosspiece rib and the boss formed on the reverse surface is minimized so that wall paper can be directly attached to a concrete surface to be formed.

The present inventors have made studies to prevent or decrease the occurrence of a sink mark on the front surface of the formwork, and have found the following. It is very difficult to completely prevent the sink mark on the surface. However, when the depth of the sink mark is not more than 0.3 mm, wall paper attached to a concrete surface has sufficient flatness without any special modification of the concrete surface. Further, when the above depth is not more than 0.2 mm, even a simple modification of a concrete surface which may be sometimes required when the depth is 0.3 mm is no longer necessary. Although differing depending upon the form, thickness and size of the crosspiece rib and the boss or molding conditions, the depth of the sink mark is generally liable to be 0.4 mm or greater. When the thickness of the rib or the effective diameter of the boss is at least 1.5 times as large as the thickness of the plate, there is almost always formed a sink mark having a depth of 0.4 mm or greater, and no conventional molding is sufficient for producing a formwork which can give a concrete surface suitable for direct attaching of wall paper without any modification of concrete surface.

The present invention provides a formwork having a front surface of which the sink mark has a small depth, and the formwork of the present invention is suitable for a recent construction engineering method and is excellent in surface properties so that it gives a concrete surface substantially free of unevenness. The excellent surface properties of the formwork can be achieved, for example, by a method in which that portion of a mold cavity which forms the front surface to contact concrete is provided with an inverse pattern which is to compensate the sink mark. The pattern can be actually provided by experimentally molding a formwork in a mold of which the surface to form the front surface is in an unprocessed flat state, trace-measuring the molded formwork for a form of a sink mark formed on the molded formwork surface, and forming an inverse pattern by treating the cavity-side mold surface by NC (Numerically Computing) machining on the basis of the measurement value. Actually, no accurately inverse pattern of a sink mark is required, and it may be experimentally determined by machining the cavity-side mold surface little by little such that the sink mark has a desired depth.

Further, the formation of the sink mark on the front surface of the formwork can be also prevented by another method in which a coating agent is applied to the cavity-mold surface. The coating agent includes organic resins such as fluorine-containing, polyimide-containing and silane-containing resins. In this method, a thin layer having a thickness of a few $\mu$m to tens $\mu$m or greater is formed on the cavity-side mold surface by applying or baking the coating agent. A mold of which the cavity-side mold is treated with the coating agent is preferred since it can be used for a general RIM method. The above thin layer of the coating agent may be formed only on that portion of a mold cavity wall and its vicinity which corresponds to a portion where the sink mark is expected to occur.

The fluorine-containing coating agent is specifically selected from fluorine-containing polymers such as polytetrafluoroethylene (PTFE), a polytetrafluoroethylene-hexafluoropropylene copolymer, a polytetrafluoroethylene-ethylene copolymer, a polychlorotrifluoroethylene-ethylene copolymer, polyvinylidene fluoride, polyvinyl fluoride, an m-(5-perfluoroisopropylphenylene)bis(perfluoroisopropylidene-glycidyl ether)-based epoxy resin, a blend of any one of the above fluorine compounds and a polyamideimide resin, and a blend of any one of the above fluorine compounds and a phenolic resin.

The polyimide-containing coating agent is selected from those which are generally commercially available as a heat-resistant insulation resin in the form of precursors of a polyimide resin, and modified imide resins such as amide-imide and ester imide.

The silane-containing coating agent is selected from modified silane compounds and those commercially available in the form of a mold releasing agent, such as FREKOTE (supplied by The Dexter Corporation) and Chemlease (supplied by Chemlease).

When the above treatment on the mold is carried out, there can be obtained a formwork which can give concrete on the surface of which the sink mark has no visually observed depth or has a depth of 0.3 mm or less, preferably 0.2 mm or less.

The formwork formed of the above crosslinked polymer, provided by the present invention, has rigidity for withstanding the weight of concrete charged, a lightweight for worker (s) easily carrying it, easiness for easy assembling in a site, durability for repeated use and pollution-free properties of generating no harmful gas at the time of incinerating it as waste. However, it has been found that when the above integrally molded formwork of the crosslinked polymer is used for forming concrete structures, there is no problem in durability in view of strength but that concrete scales (concrete stuck or deposited on the surface of the repeatedly used formwork) increase in quantity so that the formwork can no longer give a flat, unevenness-free and excellent concrete surface in the repeated use thereof. It has been further found that when formworks are used by arranging them side by side (end to end), concrete slurry penetrates a gap between side surfaces of the formworks resulting in increased amount of scales, which in its turn expand the gap to facilitate increased leak (penetration) of concrete. In this way, the cycle of increasing an amount of scales is repeated. In some cases, the dimensions of the formworks arranged side by side subsequently exceed the allowable limits of a construction design. For overcoming this problem, it is necessary to remove the scales by scraping them off the formworks, and undesirably, it is generally required to carry out this removal outside a building due to a limited space in the building. In the construction of a tall building in particular, formworks are used consecutively from ground to upper floors, thus it is a serious problem in view of time and cost to have to carry the formworks out of the building for the removal of scales when the formworks are used repeatedly. It is therefore strongly desired to develop formworks to which scales hardly adhere.

For improving a formwork in releasability from concrete, for example, JP-A-6-114816 proposes a method in which an additive is added. In this method, however, an additive is added such that the additive is uniformly contained in the formwork, and the method involves the following problems. The excellent mechanical properties of a molded article are impaired in some cases. In particular, when an additive in a liquid state at room temperature is added, the additive greatly decreases the flexural strength and tensile strength, therefore the amount of the additive that can be added is limited. Otherwise, it is required to increase the thickness of the formwork to increase the strength, which leads to an increase in the weight of the formwork.

The present inventors have studied for obtaining a formwork which substantially retains excellent mechanical properties of the above molded article of a crosslinked polymer and has improved releasability from concrete, and as a result, have found that the following formwork has excellent lightweight and durability, retains physical strength, and is free from scales so that it can be easily repeatedly used. That is, the formwork has at least two different crosslinked polymer phases formed based on a molding method of producing a molded article of a crosslinked polymer, wherein the surface to contact concrete is at least formed of the crosslinked polymer phase containing an additive for improving the releasability from concrete.

Accordingly, the present invention provides a formwork for concrete, which is an integrally molded article of a crosslinked polymer produced by the above polymerization and crosslinking of a metathesis cycloolefin, wherein (i) the formwork is formed of at least two different crosslinked polymer phases and (ii) a surface of the formwork to contact concrete is at least formed of the crosslinked polymer phase containing an additive for improving releasability from concrete.

The above "surface of the formwork to contact concrete" refers not only to that surface of a formwork which contacts concrete charged into a space formed of formworks but also to that surface of a formwork to which splashed or leaked concrete contacts when the concrete is charged, i.e., a whole or part of each of the surface of the surrounding frame (side surface of formwork itself) and the reverse surface of the formwork (surface on which ribs are formed).

The above formwork improved in the releasability from concrete, provided by the present invention, is formed of at least two polymer phases, and the polymer phase to contact concrete contains an additive for improving the releasability from concrete. This additive can be selected from known additives which are in a liquid or solid state. Of these known additives, an additive which is in a liquid state at room temperature particularly gives a formwork excellent in the releasability from concrete. The additive is preferably selected from mineral oil, liquid paraffin, phthalic acid ester compounds such as dibutyl phthalate and dioctyl phthalate, aliphatic dibasic acid ester compounds such as dioctyl adipate and diisodecyl adipate, glycol ester compounds such as ethylene glycol diacetate, and silicone oils such as dimethylsilicone and methylphenylsilicone. These additives may be used alone or in combination.

The formwork formed of at least two crosslinked polymer phases can be produced by any one of a method (1) in which a molded article of a crosslinked polymer is produced from a mixture prepared by incorporating the additive for improving the releasability from concrete to a mixture of the monomer solutions A and B, other molded article of a crosslinked polymer is produced from a mixture of the monomer solutions A and B without the above additive for improving the releasability from concrete and these two molded articles are attached to each other with an adhesive, and a method (2) in which the above additive for improving the releasability from concrete or a solution of the above additive in the monomer used in the present invention is prepared as a third solution, the monomer solution A, the monomer solution B and the third solution as raw materials are initially injected into a mold and then a mixture of the monomer solutions A and B is injected.

In the method (1), a molded article of a crosslinked polymer formed from a mixture containing the monomer solutions A and B and the additive for improving the releasability from concrete and a molded article of a crosslinked polymer formed from a mixture containing the monomer solutions A and B without the additive are produced with separate molds, and it is required to attach these molded articles to each other. However, any desired surface of a formwork which contacts concrete can be specifically formed of a phase of the crosslinked polymer formed from the mixture containing the monomer solutions A and B and the additive for improving the releasability from concrete. For example, when it is important that dimensions of formworks arranged side by side is within the allowable range of a construction design although no good excellent concrete surface is required, the method (1) is useful; only a frame of the formwork may be formed of a molded article of a crosslinked polymer formed from a mixture containing the monomer solutions A and B and the additive for improving the releasability from concrete.

In the method (2), a crosslinked polymer phase containing the additive for improving the releasability from concrete forms the surface layer of a molded article (formwork) and a crosslinked polymer phase which does not contain the above additive forms the inner surface of the formwork. Differing from the formwork obtained by the method (1), the formwork obtained by the method (2) has all the surfaces formed of the phase containing the additive. This method (2) enables the production of the formwork of the present invention all at once without any adhesive and is therefore suitable as a method for producing the formwork of the present invention. In the method (2), a third different polymer phase may be formed by preparing a fourth solution containing a different additive and incorporating the fourth solution during the molding, and a formwork produced in this manner is also included in the formwork of the present invention.

In view of the releasability from concrete, preferably, the thickness of the crosslinked polymer phase containing the additive for improving the releasability from concrete is large and the content of the additive in the crosslinked polymer phase is large. However, it is required to determine the thickness of the crosslinked polymer phase and the content of the additive on the basis of the mechanical properties of the formwork as a whole, and the above thickness and content can be easily experimentally determined by one of ordinary skill in the art. Generally, the thickness of the crosslinked polymer phase containing the additive for improving the releasability from concrete is not more than ½, preferably not more than ⅓, of the total thickness of the formwork, and the content of the additive is not more than 30% by weight, preferably not more than 15% by weight of the crosslinked polymer phase. (In the above method (2), in which the formwork always has "two polymer phases having additives" as part of the "total thickness of the formwork", the total thickness of the two polymer phases is not more than ½, preferably not more than ⅓, of the total thickness of the formwork as a whole.)

When the formwork of the present invention is produced by the above method (2), it is not easy to form a crosslinked polymer phase having a uniform thickness as a whole. However, the uniformity in the thickness of the crosslinked polymer phase is not any essential requirement of the present invention.

While the crosslinked polymer phase other than the crosslinked polymer phase forming that surface layer of the formwork which contacts concrete may also contain the additive for improving the releasability from concrete, the content of this additive is (in view of the object of the present invention) required to be smaller than the content of the additive in the crosslinked polymer phase forming the surface layer which contacts concrete.

The above-explained formwork of the present invention has various excellent performances which cannot be achieved by conventional wooden and plastic formworks. That is, the formwork of the present invention has rigidity for withstanding the weight of concrete charged, easy releasability from solidified concrete, a lightweight for worker(s) easily carrying it, easiness for nailing and sawing required at the time of assembling in a site, durability for repeated use and pollution-free properties of generating no harmful gas at the time of incinerating it as waste.

According to further studies, the present inventors have found the following. When two or more formworks of the present invention are used by arranging them side by side in series, a gap is formed in a connection portion between one formwork and another formwork, and concrete slurry penetrates the gap. As a result, scales solidifies and adheres to side portions (contact portions) of the formworks, and maintenance work for the removal of the scales is required for re-using the formworks.

The present inventors have made studies on the occurrence of a gap between side surfaces of formworks and connection means for preventing the occurrence of a gap when formworks are connected, and as a results have found the following solution.

That is, when the formworks of the present invention are connected to each other with clip(s) side by side, the above problem is overcome by a method in which the formworks are connected with a clip at a clamping point on sides within 30 mm from formwork front surface. In a preferred embodiment therefor, holes for a clamping clip are provided in those portions of the formworks which are located within 45 mm, preferably within 40 mm, from the formwork surfaces.

The above connection means and the use of the clip will be explained below.

When concrete is charged, the formwork of the present invention is generally used as it is, and the formwork has ribs and bosses on its reverse surface and side walls to be used for connecting it to other formworks. However, the formwork produced by the above method has a stress and is distorted on its side wall due to the contraction of a resin at a molding time, common to plastic products. As a result, when the formworks are connected side by side as they are, a gap is formed in a contact portion as shown by 11 in FIG. 10 in most cases.

For preventing the occurrence of the above gap in a contact portion, the present inventors have made diligent studies, and have found the following. It is very difficult to prevent the deformation of the side walls completely. However, when the gap (11 in FIG. 10) between the formworks does not exceed 0.2 mm, formation of scales can be restricted to the extent that they do not substantially influence on finish work, and the gap between the formworks can be minimized to 0.2 mm or less by optimizing the position of the connection-fixing hole and the form of a fixing (clamping) tool.

As described above, by minimizing the gap between the formworks to 0.2 mm or less as described above, the adhesion of scales onto the side surfaces of the formworks can be minimized, and the maintenance work for the removal of scales can be decreased to a great extent.

Figure 10:
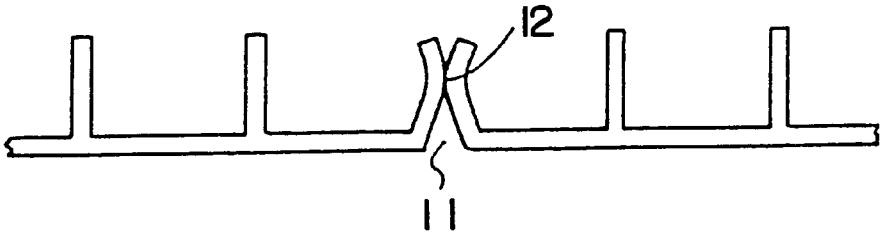
FIG. 10 shows a cross section taken along IV—IV in FIG. 9.

The method of minimizing the gap between the formworks to 0.2 mm or less comprises two elements. The first element is to select a fixing point of the formworks according to the deformation of side walls. In the integrally molded formwork of a resin, provided by the present invention, the side wall portion is moderately deflected outwardly. When the integrally molded formwork of the present invention has a side wall height of 50 mm–100 mm as is generally used, the deflection point 12 in FIG. 10 is located approximately within 30–45 mm from the edge of the front surface which is to contact concrete although the position of the deflection point varies depending upon the form of the side wall and molding conditions. When two formworks are connected with a portion outside the deflection point being a fixing point, the side wall surfaces of the formworks cannot be brought into intimate contact due to the above moderate deflection.

Figure 9:
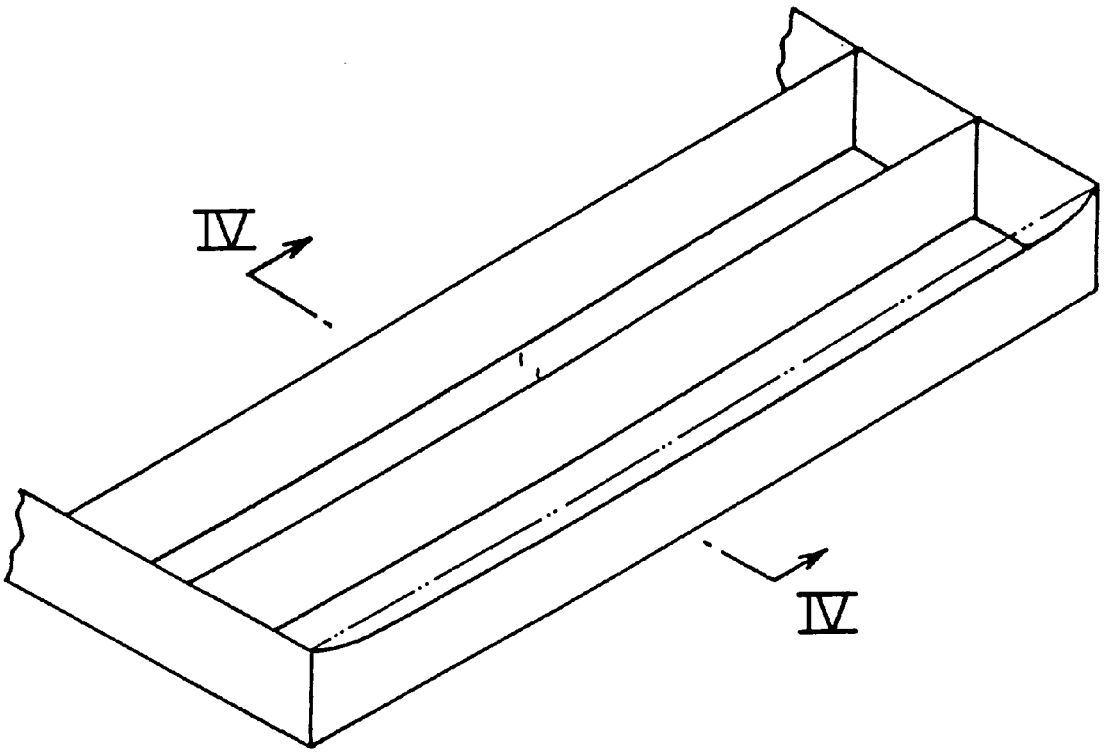
FIG. 9 shows one embodiment of the form of the formwork of the present invention.

FIGS. 9 and 10 show the above moderate deflection. The deflection is shown in an extreme state in FIGS. 9 and 10 for making the state of the deflection easily understood, and it should be therefore understood that actual deflection is considerably small as compared with the deflection shown in FIGS. 9 and 10. FIG. 9 shows a perspective view of the formwork, viewed from a position facing the reverse surface (opposite surface to the surface which contact concrete) of the formwork. The side wall of the formwork is deformed outwardly due to a strain. A two-dot chain line shows a position of the side wall which should be there if there were no deflection. FIG. 10 is a cross section taken along IV—IV in FIG. 9, in which a state of two formworks connected to each other is shown. As shown in FIG. 10, when formworks of which side walls are moderately deflected are conntected, a gap is formed near front surfaces (11 in FIG. 10) due to deflection points (the gap has a triangular cross section shown by 11 in FIG. 10).

It is considered that the deflection is caused by a strain remaining due to contraction of the resin at a molding time, while no detailed mechanism thereof is clear.

The second element for minimizing the gap is to determine positions of clip holes for facilitating the assembling and disassembling works with clips used for connecting two formworks. A bolt may be used as a fixing tool. When a bolt is used, the position of a hole provided in side walls of the formworks for fitting the bolt is a fixing point.

In an actural construction site, however, bolts are not usually used due to a time required for tightening/loosening of bolts and the handling of two kinds of parts such as bolts and nuts. Generally, there are used integrally produced metal tools (clips) as shown in FIG. 11.

Figures 11A, 11B:
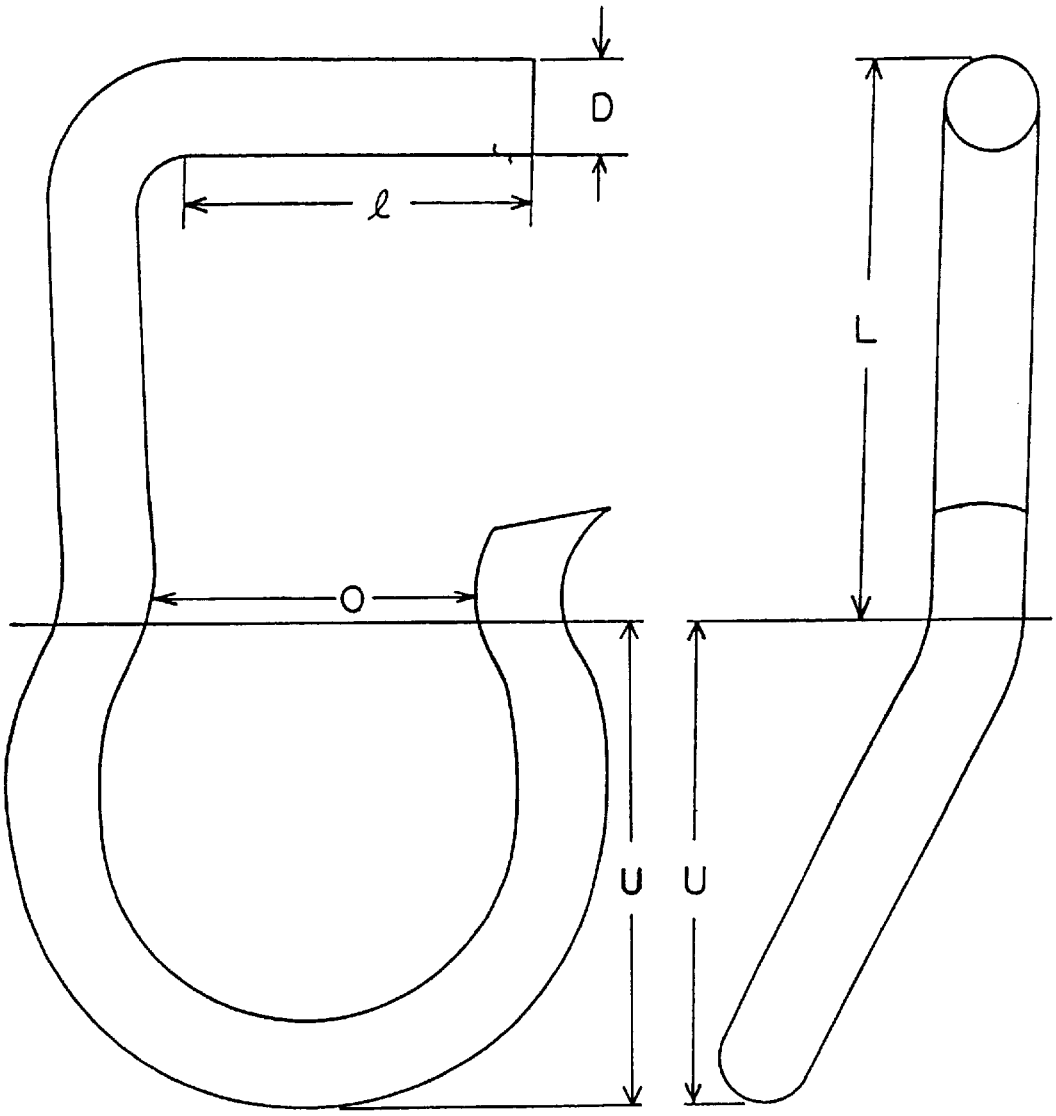
FIGS. 11A and 11B show one embodiment of a clip used for connecting formworks. A shows a plan view, and B shows a side view.
Figure 13:
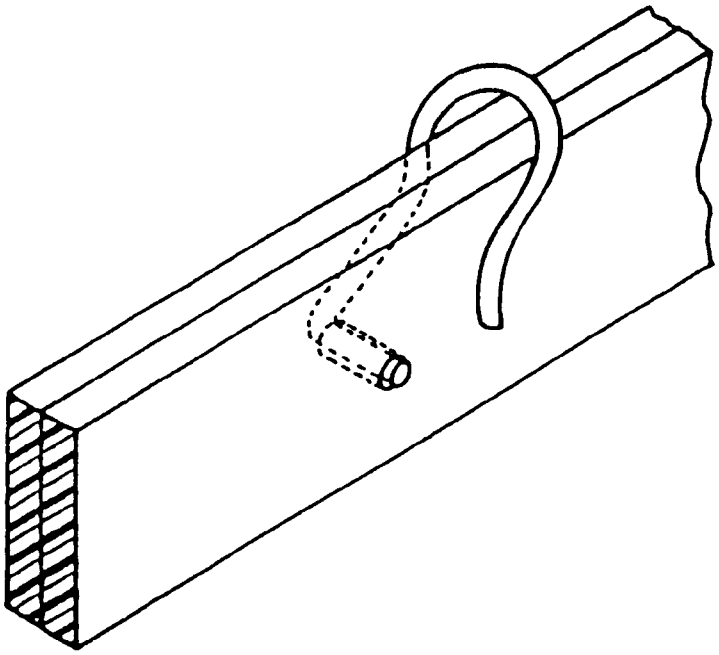
FIG. 13 is a perspective view of a clip connecting the two formworks as shown in FIG. 12, but viewed from an opposite side.
Figure 12:
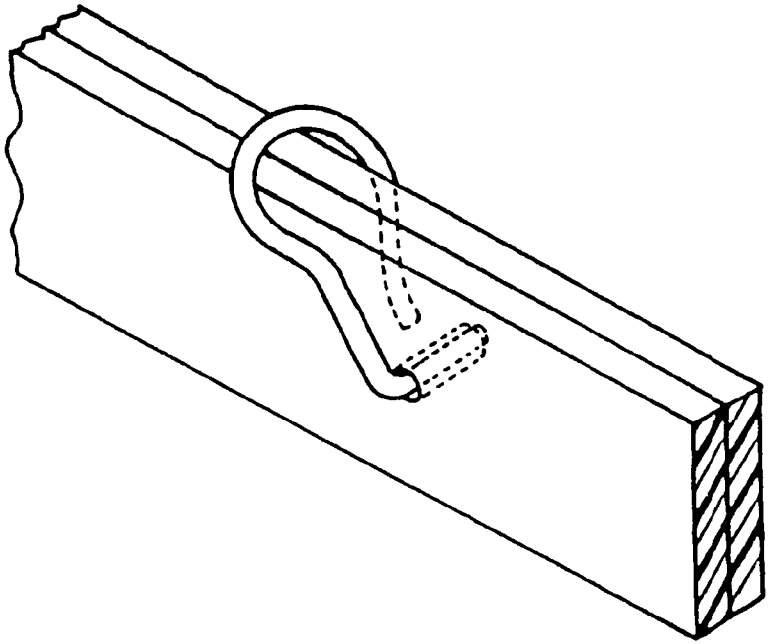
FIG. 12 is a perspective view of a clip connecting two formworks.

FIG. 11 shows one embodiment of the clip, in which FIG. 11A shows a front view, and FIG. 11B shows a side view. FIGS. 12 and 13 are perspective views showing a clip connecting and fixing two formworks from mutually opposite sides. When formworks are fixed with the clip, portions indicated by 0 in FIG. 11 constitute clamping portions.

The metal tool (clip) has a L-letter shaped portion including a straight portion (formwork insertion portion) which is to be passed through holes of side walls of two formworks and a portion consisting of a portion extending at right angles and a U-letter shaped top portion. With the clip, the open end of the U-shaped portion constitutes a clamping point. The straight portion (ι in FIG. 11) is passed through holes of the side walls such that the two formworks are embraced by the U-letter shaped portion, and the bottom portion of the U-letter shaped portion is hammered to clamp or unclamp the two formworks. In the so-clamped state, the clamping portions of the U-letter shaped portion for contact-fixing the side walls are required to be within 30 mm from the edges of the front surfaces.

To remove the clip, the bottom portion of the U-letter shaped portion is also hammered horizontally along end portions of the side walls. In this case, if the distance from the edge of the front surfaces of formworks to the positions of the holes through which the clip is inserted is greater than the distance from the edge of the front surfaces of the formworks to the clamping point of the clip, it is difficult to remove the clip. Therefore, the clamping point of the clip and the position of the hole through which the clip is passed are required to have a proper relationship. The study of the present inventors has revealed that the clip can be easily removed only when each hole is provided in a position which is 10 mm or less, preferably 5 mm or less, outside the clamping point and opposite to the edge of the front surface. That is, the holes are required to be provided within 45 mm, preferably 40 mm, particularly preferably 35 mm, from the edge of the front surface.

For connecting the formworks, a plurality of the holes are provided at intervals, for example, of 200–600 mm in a longitudinal direction as shown in FIG. 1B (in which 5 holes are provided). The size (diameter) of each hole is preferably at least 10 mm. When clips having a diameter of 13 mm are used, the diameter of each hole is required to meet the diameter of the clips, or is properly 14 mm.

When the formworks of an integrally molded resin are connected by the above method, the amount of scales in a connection portion is minimized and the formworks are excellent in workability.

EXAMPLES

The present invention will be explained hereinafter with reference to Examples, which are intended for an explanation purpose, therefore the present invention shall not be limited to these.

Example 1

An aluminum mold prepared for producing a molded article having a form shown in FIG. 1 (lateral length 600 mm, longitudinal length 1,996 mm, a height 62 mm, plate thickness 4 mm) was used. The formworks produced in Example 1 had the following dimensions.

a=1,996 mm, b=600 mm, c=4 mm, d=8 mm, e=62 mm, f=6 mm, g=35 mm, h=3 mm, i=10 mm, k=30 mm, θ=15°, H=171 mm

Namely, a=longitudinal length of plate, b=lateral length of plate, c=thickness of plate, d=thickness of frame, e=height of frame, f=crosspiece rib, g=distance between small rib and neighboring small rib, h=average thickness of small ribs, i=height of small rib, k=length of a structural portion in which junction member can be put in, and θ=smaller angle of angles formed between the length direction of each small rib and a direction in parallel with b.

Monomer solutions

Preparation of monomer solution A

20 Parts by weight of tungsten hexachloride was added to 70 parts by weight dry toluene under nitrogen current, and then a solution consisting of 2 parts by weight of nonylphenol and 16 parts by weight of toluene was added to obtain a 0.5 M tungsten-containing catalyst. Nitrogen gas current was applied overnight to purge this solution of hydrogen chloride gas formed by a reaction between the tungsten hexachloride and the nonylphenol, and 1 part by volume of acetylacetone was added to 10 parts by volume of the resultant solution to obtain a solution of a catalyst for polymerization.

Then, 3 parts by weight of an ethylene-propylene-ethylidenenorbornene polymer rubber having an ethylene content of 70 mol % and 2 parts by weight of Ethanox 702 as an oxidation stabilizer were added to a monomer mixture containing 95 parts by weight of purified dicyclopentadiene (purity 99.7%) and 5 parts by weight of purified ethylidenenorbornene (purity 99.5%), to obtain a solution. Then, the above catalyst solution was added to the so-obtained solution such that the tungsten content was 0.01 mol/liter, to give a monomer solution A containing a catalyst component (solution A).

Preparation of monomer solution B

An activator mixture solution for polymerization, prepared by mixing trioctylaluminum, dioctylaluminum iodide and diglyme in a trioctylaluminum/dioctylaluminum iodide/diglyme molar ratio of 85/15/100, was mixed with a mixture containing 95 parts by weight of purified dicyclopentadiene, 5 parts by weight of purified ethylidenenorbornene and 3 parts by weight of ethylene-propylene-ethylidenenorbornene polymer rubber having an ethylene content of 70 mol %, so that the aluminum content was 0.03 mol/liter, to give a monomer solution B containing an activator component (solution B). The solution B had a viscosity of 300 cps at 30° C.

Molding

A cavity mold member of the aluminum mold was heated to 90° C., a core mold member of the aluminum mold was heated to 70° C., and then the mold was closed. The molding was carried out with a RIM machine, and the solutions A and B in equal amounts were injected into the mold through a mixing head of the RIM machine. The mold was opened 5 minutes after the solutions were injected and filled in the cavity, and a molded article of a crosslinked polymer was taken out.

Attaching of junction member

A wooden square timber having a length of 586 mm and a cross section of 30 mm×50 mm was put in a junction member-fitting groove portion (upper portion in FIG. 1) of the molded article of crosslinked polymer (FIG. 3B), and fixed with screws.

Evaluation as formwork

Two molded articles of crosslinked polymer having a wooden square timber, obtained in the above manner, were connected to each other by attaching and fixing side walls (B in FIG. 1) to each other with clips, to prepare a wall formwork set. Further, another wall formwork set was prepared in the same manner as above. These formwork sets were positioned so that a space into which concrete was to be charged had a thickness of 150 mm by allowing the formwork sets to face each other and the longitudinal direction of each formwork was lined with a wooden square timber on top.

When the concrete was charged into the space, the formwork was not shifted in position, nor did it undergo deformation such as swelling. After the concrete was cured, the formworks were easily released, and the concrete surface showed neither any change in color nor defective curing. The above molded articles had no problem when used repeatedly several times.

Example 2

An aluminum mold prepared for producing a molded article having a form shown in FIG. 4 (width 600 mm, length 1,996 mm, a depth 62 mm, plate thickness 4 mm) was used. The formworks produced in Example 2 had the following dimensions.

a=1,996 mm, b=600 mm, c=4 mm, d=8 mm, c=62 mm, f=6 mm, g=35 mm, h=3 mm, i=10 mm, k=30 mm, θ=15°, H=171 mm

The above symbols were as defined in Example 1.

Molded articles were obtained under same conditions as those in Example 1 except that the mold was replaced with the above mold. Similarly to Example 1, the molded articles were easily released after concrete was cured, and the concrete surface showed neither any change in color nor defective curing.

Example 3

An aluminum mold prepared for producing a molded article having a form shown in FIG. 5 (width 600 mm, length 1,996 mm, a depth 62 mm, plate thickness 3–5 mm) was used. The formworks produced in Example 3 had the following dimensions.

a=1,996 mm, b=600 mm, c1=3 mm, c2=5 mm, d=8 mm, e=62 mm, f=6 mm, g=35 mm, h=3 mm, i=10 mm, j=7 mm, k=30 mm, θ=15°, H=171 mm, m1=12 mm, m2=12 mm, m3=10 mm, m4=7 mm.

The above symbols, a, b, c, d, e, g, h, i, k and θ were as defined in Example 1. f is an average thickness of crosspiece ribs on their tops when the molded article was placed as a formwork member, and j is an average thickness of crosspiece ribs at their bottoms when the molded article was placed as a formwork member. m1–m4 are thickness values of enlarged rib portions in the order of m1 in the lowest place and m4 in the uppermost place when the molded article was placed as a formwork member.

Molded articles were obtained under the same conditions as those in Example 1 except that the mold was replaced with the above mold. Similarly to Example 1, the molded articles were easily released after concrete was cured, and the concrete surface showed neither any change in color nor defective curing.

Example 4

An aluminum mold prepared for producing a molded article having a form shown in FIG. 6 (width 450 mm, length 2,528 mm, a depth 62 mm, plate thickness 4 mm) was used. The formworks produced in Example 4 had the following dimensions. Those symbols shown below but not shown in FIG. 6 indicate as shown in FIG. 1.

a=2,528 mm, b=450 mm, c=4 mm, d=8 mm, e=62 mm, f=5 mm, g=33 mm, h=3 mm, i=10 mm, k=30 mm, θ=15°, H=231 mm

The above symbols were as defined in Example 1. The distance b' from an outer surface edge of a side wall to a center of a longitudinal rib was 105 mm, and the distance b" from a center of a longitudinal rib to a center of a neighboring longitudinal rib was 80 mm. Further, a thickness-increased portion (8) to which a separator was to be attached had the form of a conical trapezoid unlike a rectangular form in Example 1.

Molded articles were obtained under same conditions as those in Example 1 except that the mold was replaced with the above mold. Similarly to Example 1, the molded articles were easily released after concrete was cured, and the concrete surface showed neither any change in color nor defective curing.

Example 5

An aluminum mold prepared for producing a molded article having a form shown in FIG. 7 (width 600 mm, length 2,026 mm, a depth 62 mm, plate thickness 5 mm) was used. The formworks produced in Example 4 had the following dimensions. Those symbols shown below but not shown in FIG. 7 indicate as shown in FIG. 1.

a=2,026 mm, b=600 mm, c=5 mm, d=8 mm, e=62 mm, f=5 mm, g=33 mm, h=3 mm, i=10 mm, θ=15°, H based on a'=60 mm, H based on a"=117 mm The above symbols were as defined in Example 1. The form of each small rib was not straight but wavy. The distance a' of a range where small ribs were formed was ¼ of a, and the distance a" of a range where small ribs were formed was ½ of a.

Molded articles were obtained under same conditions as those in Example 1 except that the mold was replaced with the above mold. Similarly to Example 1, the molded articles were easily released after concrete was cured, and the concrete surface showed neither any change in color nor defective curing.

Example 6

Preparation fo solution A

28 Parts by weight of tungsten hexachloride was added to 80 parts by weight of dry toluene under nitrogen current, and then a solution of 1.3 parts by weight of tert-butanol in 1 part by weight of toluene was added. The mixture was stirred for 1 hour. Then, a solution containing 18 parts by weight of nonylphenol and 14 parts by weight of toluene was added, and the mixture was stirred for 5 hours while nitrogen current was applied for purging. Further, 14 parts by weight of acetylacetone was added, and while hydrogen chloride gas being formed as by-product was purged with nitrogen, the mixture was continuously stirred overnight to give a catalyst solution for polymerization.

Then, 3 parts by weight of an ethylene-propylene-ethylidene-norbornene copolymer rubber having an ethylene content of 70 mol % and 2 parts by weight of Ethanox 702 as an oxidation stabilizer were added to a monomer mixture containing 95 parts by weight of purified dicyclopentadiene and 5 parts by weight of purified ethylidenenorbornene to obtain a solution. Then, the above catalyst solution was added to the so-obtained solution so that the tungsten content was 0.01 mol/liter, to give a monomer solution A containing a catalyst component (solution A).

Preparation of monomer solution B

An activator mixture solution for polymerization, prepared by mixing trioctylaluminum, dioctylaluminum iodide and diglyme in a trioctylaluminum/dioctylaluminum iodide/diglyme molar ratio of 85/15/100, was added to a solution of 3 parts by weight of ethylene-propylene-ethylidenenorbornene copolymer rubber having an ethylene content of 70 mol % in a monomer mixture containing 95 parts by weight of purified dicyclopentadiene and 5 parts by weight of purified ethylidenenorbornene, so that the aluminum content was 0.03 mol/liter, to give a monomer solution B containing an activator component (solution B).

Molding

Molding was carried out with a mold of forged aluminum having the form shown in FIG. 8. Though this formwork has small ribs similar to those shown in FIG. 6, they are not shown in FIG. 8.

The formwork had the following dimensions (for symbols, see FIG. 8).

In the form of a plate:

Longitudinal length (a)=2,026 mm

Lateral length (b)=600 mm

Thickness (c)=6 mm

In a surrounding frame (3):

Thickness (d)=7 mm

Height (e)=56 mm

In ribs (4 ribs) in a longitudinal direction:

Thickness (f)=12 mm

Height (e)=56 mm

In dimensions of boss 9:

Diameter of bottom portion (g)=70 mm

Diameter of top portion (h)=30 mm

Diameter of hole (i)=10 mm
Height (j)=12 mm

The cavity mold member of the above aluminum mold was heated to 90° C., and the core mold member thereof was heated to 70° C. A cotton cloth was immersed into a silane coating agent and was tightly wrung. Then, the wall surface of the cavity-side mold was wiped with the wet cotton cloth, and the cavity-side mold was allowed to stand for at least 5 minutes, to form a thin coating layer on the cavity wall surface. The molding was carried out with a RIM machine, and the solutions A and B in equal amounts were injected into the cavity through a mixing head of the RIM machine. The mold was opened 2 minutes after the solutions were injected and filled in the cavity, and a formwork of a crosslinked polymer was taken out.

Sink marks on those portions of the concrete-contacting front surface of the above-obtained formwork which corresponded to ribs and bosses were measured for depth with a SURFCOM supplied by Tokyo Seimitsusha to show 0–0.1 mm. This measuring apparatus is to measure a concave and convex shape of a cross section of a molded article by a contact-needle method in which a molded article surface is scanned with a needle.

Evaluation as formwork

Two molded articles of crosslinked polymer, obtained in the above manner, were connected by attaching side walls (B in FIG. 8) to each other and fixing them by inserting clips through holes 4 of the side walls, to prepare a wall formwork set. Further, another wall formwork set was prepared in the same manner as above. These formwork sets were positioned so that a space into which concrete was to be charged had a thickness of 150 mm by allowing the formwork sets to face each other. Then, concrete was charged into the so-formed space from above.

As a result, when the concrete was charged, the formwork was not shifted in position, nor did it undergo deformation such as swelling (swelling of the plate 1 under the pressure of the concrete). After the concrete was cured, the formworks were easily released, and the concrete surface showed neither any change in color nor defective curing. Further, no projection was visually or manually observed on those portions of the concrete surface which corresponded to sink marks on the front surface of the formworks. When a wall paper sheet was directly applied to the concrete surface, a flat surface as an appearance was obtained.

Further, the above formworks were integrally molded articles, easy to handle, light in weight and excellent in durability for repeatedly using them several times.

Comparative Example 1

Molding

Formworks were obtained in the same manner as in Example 6 except that a forged aluminum mold of which the cavity mold member was not coated with a silane coating agent was used in place.

Sink marks in the above obtained formwork of a crosslinked polymer were measured for depth values in the same manner as in Example 6 to show 0.4–0.5 mm.

Evaluation as formwork

The above-obtained formworks were used, and concrete was charged under the same conditions as those in Example 6. The cured concrete surface showed visually clear convex streaks having a width of about 5 mm and a circular convex portion having a diameter of 50 mm corresponding to the sink marks of the formworks. Clearly, the concrete therefore had no flat surface. It was not sufficient to treat the concrete surface with a simple sander (a polishing device) for removing the convex streaks and the convex portions, and it was required to scrape these portions off carefully before attaching a wall paper sheet.

Example 7

The same solutions A and B as those in Example 6 and the same forged aluminum mold as that in Example 6 were used. As a coating agent for the cavity mold member, a solution containing 10 parts by weight of polyamic acid as a precursor of a polyimide, 40 parts by weight of n-methyl-2-pyrrolidone and 50 parts of methyl ethyl ketone was used.

The coating of the mold cavity member was carried out by applying the above solution to the cavity wall surface with a brush, increasing the mold temperature up to 100° C. over 2 hours and maintaining the mold at 100° C. for 10 hours. As a result, no coating agent was peeled off, nor did it adhere to a molded article, and the mold had no problem in practical use.

The above-coated mold was used, and molding was carried out in the same manner as in Example 1. The resultant formwork of a crosslinked polymer was taken out and measured for depth values of sink marks to show 0.05–0.2 mm. Formworks of a crosslinked polymer obtained in the above manner were used, and concrete was charged in the same manner as in Example 6. As a result, similarly to Example 6, the formworks were not shifted in position at the time of charging the concrete, nor did it undergo deformation such as swelling. After the concrete was cured, the formworks were easily released, and the concrete surface showed neither any change in color nor defective curing. Further, no projection was visually or manually observed on those portions of the concrete surface which corresponded to sink marks on the front surface of the formworks. After a wall paper sheet was directly applied to the concrete surface, no convex portion was visually or manually observed.

Example 8

The same solutions A and B as those in Example 6 and the same forged aluminum mold as that in Example 6 were used. In this Example, a groove having a maximum depth of 0.2 mm was made in those portions of the cavity mold member which corresponded to ribs and bosses of a formwork, with a drill having a spherical tip portion having a curvature radius of 151 mm.

The above mold having a groove was used as a cavity mold member, and molding was carried out in the same manner as in Example 6. The resultant formwork of a crosslinked polymer was taken out and measured for depth values of sink marks to show 0.2–0.3 mm. Formworks of a crosslinked polymer obtained in the above manner were used, and concrete was charged in the same manner as in Example 6. As a result, similarly to Example 6, the formworks were not shifted in position at the time of charging the concrete, nor did it undergo deformation such as swelling. After the concrete was cured, the formworks were easily released, and the concrete surface showed neither any change in color nor defective curing. Further, no projection was visually observed on those portions of the concrete surface which corresponded to sink marks on the front surface of the formworks, while a slight projection was felt when carefully manually observed. After a wall paper sheet was directly attached to the concrete surface, no convex portion was visually or manually observed.

Example 9

A forged aluminum mold having a cavity for producing a crosslinked polymer having a form shown in FIG. 8 was used. The dimensions in FIG. 8 were as follows.

Form of plate

Longitudinal length (a)=2,026 mm
Lateral length (b)=600 mm

Thickness (c)=6 mm

Surrounding frame (W):

Thickness (d)=7 mm

Height (e)=56 mm

Ribs (4 ribs) in a longitudinal direction:

Thickness (f)=12 mm

Height (e)=56 mm

A RIM machine having a mixing head for three solutions was used. The first solution was the same as the solution A in Example 6. The second solution was the same as the solution B in Example 6. The RIM machine was adjusted such that the first and second solutions were injected at a rate of 0.55 kg/second each. The third solution is dibutyl phthalate (to be referred to as "DBP" hereinafter), and the RIM machine was adjusted such that the third solution was injected at a rate of 70 g/second.

The cavity mold member of the aluminum mold was heated to 90° C., a core mold member was heated to 60° C., and then the mold was closed. Then, for first three seconds, the first solution, the second solution and the third solution were injected into the mold through the mixing head. Then, the injection of the third solution was terminated, and the injection of the first and second solutions into the mold through the mixed head was kept for the subsequent 10 seconds. The mold was opened 2 minutes after the mold was filled with the solution mixture, and a molded article of a crosslinked polymer was taken out.

For observing a dispersion state of DBP, a dispersion of a small amount of activated carbon in DBP was molded under the same conditions as above. The front and reverse surfaces of the resultant formwork were black. The formwork was cut and its cross section was observed to show that black portions (surface sides) and a brown phase of the crosslinked polymer alone (inner side) were distinctly separated. The thickness of one of the black portion was 0.5–0.9 mm.

The above-obtained molded article (free of activated carbon) was measured for a flexural modulus. For comparison, a mold article of a crosslinked polymer alone (Comparative Example 2) and a molded article obtained by injecting DBP from beginning to end in the above molding (Comparative Example 3, a mixture in which DBP was uniformly mixed) were also measured for flexural moduli. As shown in Table 1, the molded article in Example 9 showed excellent physical property.

TABLE 1

| Sample | Flexural modulus |
|---|---|
| Example 9 | 19,000 kg/cm$^2$ |
| Comparative Example 2 (crosslinked polymer alone) | 19,000 kg/cm$^2$ |
| Comparative Example 3 (Uniformly mixed DBP) | 15,500 kg/cm$^2$ |

Evaluation as formwork

Two molded articles (free of activated carbon) of crosslinked polymer, obtained in the above manner, were connected to each other by attaching and side walls (B in FIG. 1) to each other and fixing them by inserting clips through small holes 4 of the side walls, to prepare a wall formwork set. Further, another wall formwork set was prepared in the same manner as above. These formwork sets were positioned so that a space into which concrete was to be charged had a thickness of 150 mm by allowing the formwork sets to face each other. Then, concrete was charged into the so-formed space from above. After the concrete was cured, the formworks were released, and the surface states of the formworks were observed.

The above operation was repeated several times, and the formwork surfaces were observed for a state in which concrete adheres thereto. As shown in Table 2, the results were excellent or the molded articles in Example 9 were almost free from the adherence of concrete to their surfaces.

TABLE 2

Results of formwork use test

| Sample | Surface state of formwork after the formwork was used 10 times repeatedly. |
|---|---|
| Example 9 | Almost no concrete adhered to surface. |
| Comparative Example 2 | Concrete adhered to surface all over. |
| Comparative Example 3 | No difference from Example 9. |

As described above, the formwork used in Example 9 was improved in the releasability from concrete without any decrease in mechanical properties.

Examples 10–14

Molded articles of crosslinked polymer were produced with the same mold and the same molding machine as those in Example 9 while adding additives shown in Table 3 for a predetermined period of time (injection time in Table 3) in the beginning. It was found by molding monomers containing a dispersion of a small amount of activated carbon in additives that a phase containing an additive and a phase containing no additive were distinctly separated. Table 3 summarizes the conditions of adding the additives and the results of measurement of thickness values of black portions on one side of cross sections of the molded articles. The molding conditions other than those shown in Table 3 were the same as those in Example 9.

The above-obtained formworks (molded articles containing no activated carbon) were evaluated for releasability from concrete in the same manner as in Example 9. Table 4 shows the results.

TABLE 3

| Ex. No. | Additive | Amount (g/second) | Injection time (second) | Thickness of black portion on one side of cross section (mm) |
|---|---|---|---|---|
| 10 | Dioctyl phthalate | 35 | 3.0 | 0.5–0.9 |
| 11 | Liquid paraffin | 70 | 3.0 | 0.5–0.9 |
| 12 | Dioctyl adipate | 70 | 4.0 | 0.6–0.2 |
| 13 | Dimethyl silicone | 35 | 3.0 | 0.5–0.9 |
| 14 | Process oil (Shell 729HP) | 70 | 2.0 | 0.2–0.7 |

TABLE 4

| Example No. | Surface state of formwork after the formwork used repeatedly 10 times |
|---|---|
| 10 | Concrete slightly adhered to surface. |
| 11 | Almost no concrete adhered to surface. |
| 12 | Almost no concrete adhered to surface. |
| 13 | Concrete slightly adhered to surface. |
| 14 | Almost no concrete adhered to surface. |

Comparative Example 2

Molded articles of crosslinked polymer were obtained in the same manner as in Example 9 except that DBP was not used (that is, no third solution was injected). These molded articles were evaluated as a formwork in the same manner as in Example 9. Tables 1 and 2 show the results. The formwork showed an excellent flexural modulus, while a large amount of concrete adhered to the formwork surface.

Comparative Example 3

Molded articles of crosslinked polymer were obtained in the same manner as in Example 9 except that DBP was injected from beginning to end (for the same period as that for which the first and second solutions were injected). These molded articles were evaluated as a formwork in the same manner as in Example 9. Tables 1 and 2 show the results. Almost no concrete adhered to the formwork surface, while the flexural modulus of the formwork was considerably lower than that in Example 9.

Example 15

Molding

A forged aluminum mold having the form shown in FIG. 8 was used.

The dimensions in FIG. 8 were as follows.

In the form of plate:

Longitudinal length (a)=2,026 mm

Lateral length (b)=600 mm

Thickness (c)=6 mm

In surrounding frame 3:

Thickness (d)=8 mm

Height (e)=62 mm

Ribs (4 ribs) in a longitudinal direction:

Thickness (f)=12 mm

Height (e)=62 mm

The cavity mold member of the aluminum mold was heated to 90° C., and a core mold member was heated to 70° C. The mold was closed, and equal amounts of the same solutions A and B as those in Example 6 were injected into the mold through a mixing head with a RIM machine. The mold was opened 5 minutes after the mold was filled with the solution mixture, and a molded article of a crosslinked polymer was taken out.

In the above-obtained formwork of crosslinked polymer, that portion of the side wall ranging about 35 mm from the edge of the front surface was opened outwardly and had a deviation of 1 mm. The remaining portion of the side wall which extended from the about 35 mm apart portion to the outermost portion extended nearly at right angles to the front surface forming a slight arc.

When two formworks obtained as above were brought into contact side by side with the front surfaces upward, a 1 mm gap was formed between the formworks on a front surface side.

Five holes having a diameter of 14 mm were made at equal intervals along that portion of the side wall portion of each of the two formworks, which were 20 mm apart from the edge of the front surface, and the two formworks were intimately fixed side wall to side wall with clips having the form shown in FIG. 11. As a result, the gap formed between the formworks on the front surface side did not exceed 0.1 mm. In this case, the fixing points of the clips were located in positions 15 mm apart from the edge of the front surface. The above clips had the following dimensions (symbols as used in FIG. 11).

Dimensions of clip

Size of clip (D)=13 mm

Length of formwork insertion portion (ι)=30 mm

Length of L letter portion (L)=63 mm

Length of U letter portion (U)=63 mm

Opening of U letter portion (O)=15 mm

Evaluation as formwork

Two formworks were connected as described above to prepare a wall formwork set. Further, another wall formwork set was prepared in the same manner as above. These formwork sets were positioned such that the connection portion stood vertically and that those surfaces of the formwork sets which were to contact concrete faced each other at a distance of 150 mm in parallel. Then, concrete was charged into the so-formed space from above.

As a result, when the concrete was charged, the formworks were not shifted in position, nor did they undergo deformation such as swelling (swelling of the plate 1 in FIG. 8 under the pressure of the concrete). After the concrete was cured, the formworks were easily released, and the concrete surface showed neither any change in color nor defective curing. The amount of concrete which had penetrated the contact portion of the formworks was very small, and only a dust-like adherend was observed so that it was easily removed by simply wiping.

Further, the above formworks were integrally molded articles, easy to handle, light in weight and excellent in durability for repeatedly using them several times.

Referential Example 1

The same two formworks as those in Example 15 were connected with the same clips as those used in Example 15 while holes were made along that portion of the side wall portion of each of the two formworks, which were 50 mm apart from the edge of the front surface. The fixing points of the clips were located in positions about 33 mm apart from the edge of the front surface. The gap between the formworks on a front surface side had a size of 0.5 mm. The clips were in a state in which their side portions were extremely opened outwardly.

Evaluation as formwork

Two sets of the above-connected formworks were used, and concrete was charged in the same manner as in Example 15. After the concrete was cured, the formworks were removed. Scales adhered to the side surface of each formwork, and it was required to scrape the scales off all over with a chaplet rod. Some clips did not come off even by hammering them in the bottom of their U letter portion, and it was required to use a bar for their removal.

According to the present invention, there is provided a large-sized, integrally molded, lightweight formwork for concrete, by a reaction injection molding method in which a metathesis polymerizable cycloolefin is polymerized in the presence of a catalyst component of a metathesis catalyst system and an activator component of a metathesis catalyst system. The formwork of the present invention does not require any crosspieces-attaching work so that it overcomes the shortage of laborer, it is light in weight sufficient for aged workers and excellent in workability, it is good for repeated use so that it saves wood, and it is less expensive.

Further, the formwork of the present invention is easy to handle and excellent in durability required for repeated use, and it gives an excellently flat concrete surface and is excellent in releasability from concrete. The formwork of the present invention meets the protection of natural resources and deficiency of skilled workers, it meets with various forms and sizes required in markets and with uniformity in quality and a decrease in weight. Further, it meets strong demands in a market where a wall paper sheet is directly attached to a concrete surface.

What is claimed is:

1. A plastic, lightweight formwork for concrete, which is an integrally molded article of a crosslinked polymer obtained by mixing a monomer solution A of a metathesis polymerizable cycloolefin containing a catalyst component of a metathesis polymerization catalyst system and a monomer solution B of a metathesis polymerizable cycloolefin containing an activator component of a metathesis polymerization catalyst system, injecting the mixture into a mold and subjecting the mixture to polymerization and a crosslinking reaction in the mold, wherein:

(1) the formwork has a rectangular plate having a front surface and having a longitudinal length of 1,000–4,000 mm, a lateral length which is ½–1/10 of the longitudinal length and a thickness of 3–10 mm, and a reverse surface of the plate has a frame surrounding the plate and 3 to 6 crosspiece ribs are longitudinally formed on the reverse surface, the frame surrounding the plate having a thickness of 5 to 20 mm and a height of 40 to 100 mm, (2) the crosspiece ribs integrally and longitudinally formed on the reverse surface of the plate have the total thickness of 1/10–1/30 of the lateral length of the plate and the height equivalent to the height of the surrounding frame and are joined to the surrounding frame at both ends thereof, and (3) the formwork has a plurality of small reinforcing ribs on at least part of the reverse surface thereof, and the small ribs satisfies the following characteristics (i)–(v), (i) $2.5 \leqq h \leqq 5$ (ii) $a/100 \leqq H \leqq a/5$ (iii) $5 \leqq i \leqq 20$ (iv) $0 \leqq \theta \leqq 45$, and (v) each small rib has such a length that its both ends are connected to the neighboring longitudinal crosspiece ribs or to a longitudinal crosspiece rib and a longitudinal frame, wherein h is an average thickness of each small rib in the unit of mm provided that the average thickness refers to the thickness of each small rib measured at a point as high as ½ of the small-rib height, H is a total thickness of the small ribs located in one column in the longitudinal direction in the unit of mm, a is a length of the formwork in the longitudinal direction of the formwork in the unit of mm, i is a height of each small rib in the unit of mm, and θ is a smaller angle of angles formed between the length direction of each small rib and a direction in parallel with the lateral direction of the formwork.

2. The formwork of claim 1, wherein the formwork has at least three crosspiece ribs integrally formed on the reverse surface of the plate, or at least three crosspiece ribs and at least one boss integrally formed on a reverse surface of the plate, and sink marks which occurs on a front surface to contact concrete, due to a presence of the crosspiece ribs and the boss have a depth of not more than 0.3 mm.

3. The formwork of claim 1, wherein (i) the formwork is formed of at least two different crosslinked polymer phases and (ii) a surface of the formwork to contact concrete is at least formed of the crosslinked polymer phase containing an additive for improving releasability from concrete.

4. The formwork of claim 3, wherein the additive for improving releasability from concrete is at least one member which is selected from the group consisting of mineral oil, liquid paraffin, phthalic acid ester compounds, aliphatic dibasic acid ester compounds, glycol ester compounds, and silicone oils.

5. The formwork of claim 1, wherein a longitudinally disposed side wall of the frame of the formwork has a plurality of holes through which clamping clips are to be passed for connecting the side wall of the formwork to a side wall of other formwork by vertically arranging the formworks side by side, and the holes are provided within 45 mm from an edge of a surface to contact concrete.

6. The formwork of claim 1, wherein the small reinforcing ribs feature (iv) angle θ has a value of 10°–30°.

7. The formwork of claim 1, wherein the formwork has a plurality of small reinforcing ribs on at least 20% of the reverse surface thereof.

8. The formwork of claim 1, wherein the injection molding is carried out by injecting together the solution A, the solution B and a third solution containing an additive for improving releasibility from concrete to partially fill the mold, then stopping the injection of the third solution and continuing the injection of the solution A and the solution B until the mold is full such that the additive for improving releasibility from concrete is concentrated in the crosslinked polymer on the front and the reverse surfaces of the mold.

9. The formwork of claim 8, wherein the additive for improving releasability from concrete is at least one member which is selected from the group consisting of mineral oil, liquid paraffin, phthalic acid ester compounds, aliphatic dibasic acid ester compounds, glycol ester compounds, and silicone oils.

10. A method for molding a plastic, lightweight formwork for concrete, which is an integrally molded article of a crosslinked polymer which comprises mixing a monomer solution A of a metathesis polymerizable cycloolefin containing a catalyst component of a metathesis polymerization catalyst system and a monomer solution B of a metathesis polymerizable cycloolefin containing an activator component of a metathesis polymerization catalyst system, injecting the mixture into a mold and subjecting the mixture to polymerization and a crosslinking reaction in the mold, wherein:

(1) the formwork has a rectangular plate having a front surface and having a longitudinal length of 1,000–4,000 mm, a lateral length which is ½–1/10 of the longitudinal length and a thickness of 3–10 mm, and a reverse surface of the plate has a frame surrounding the plate and 3 to 6 crosspiece ribs are longitudinally formed on the reverse surface, the frame surrounding the plate having a thickness of 5 to 20 mm and a height of 40 to 100 mm, (2) the crosspiece ribs integrally and longitudinally formed on the reverse surface of the plate have the total thickness of 1/10–1/30 of the lateral length of the plate and the height equivalent to the height of the surrounding frame and are joined the surrounding frame at both ends thereof, and (3) the formwork has a plurality of small reinforcing ribs on at least part of the reverse surface thereof, and the small ribs satisfies the following characteristics (i)–(v), (i) $2.5 \leqq h \leqq 5$ (ii) $a/100 \leqq H \leqq a/5$ (iii) $5 \leqq i \leqq 20$ (iv) $0 \leqq \theta \leqq 45$, and (v) each small rib has such a length that its both ends are connected to the neighboring longitudinal crosspiece ribs or to a longitudinal crosspiece rib and a longitudinal frame, wherein h is an average thickness of each small rib in the unit of mm provided that the average thickness refers to the thickness of each small rib measured at a point as high as ½ of the small-rib height, H is a total thickness of the small ribs located in one column in the longitudinal direction in the unit of mm, a is a length of the formwork in the longitudinal direction of the formwork in the unit of mm, i is a height of each small rib in the unit of mm, and θ is a smaller angle of angles formed between the length direction of each small rib and a direction in parallel with the lateral direction of the formwork.

11. The method of claim 10 for molding a formwork, wherein the formwork has at least three crosspiece ribs integrally formed on the reverse surface of the plate, or at least three crosspiece ribs and at least one boss integrally formed on a reverse surface of the plate, and sink marks which occur on a front surface to contact concrete, due to a presence of the crosspiece ribs and the boss have a depth of not more than 0.3 mm.

12. The method of claim 10 for molding a formwork, wherein (i) the formwork is formed of at least two different crosslinked polymer phases and (ii) a surface of the formwork to contact concrete is at least formed of the crosslinked polymer phase containing an additive for improving releasability from concrete.

13. The method of claim 12 for molding a formwork, wherein the additive for improving releasability from concrete is at least one member which is selected from the group consisting of mineral oil, liquid paraffin, phthalic acid ester compounds, aliphatic dibasic acid ester compounds, glycol ester compounds, and silicone oils.

14. The formwork of claim 10, wherein the small reinforcing ribs feature (iv) angle θ has a value of 10°–30°.

15. The formwork of claim 10, wherein the formwork has a plurality of small reinforcing ribs on at least 20% of the reverse surface thereof.

16. The formwork of claim 10, wherein the injection molding is carried out by injecting together the solution A, the solution B and a third solution containing an additive for improving releasibility from concrete to partially fill the mold, then stopping the injection of the third solution and continuing the injection of the solution A and the solution B until the mold is full such that the additive for improving releasibility from concrete is concentrated in the crosslinked polymer on the front and the reverse surfaces of the mold.

17. The formwork of claim 16, wherein the additive for improving releasability from concrete is at least one member which is selected from the group consisting of mineral oil, liquid paraffin, phthalic acid ester compounds, aliphatic dibasic acid ester compounds, glycol ester compounds, and silicone oils.

* * * * *